US010180655B2

(12) United States Patent
Shibuya et al.

(10) Patent No.: US 10,180,655 B2
(45) Date of Patent: Jan. 15, 2019

(54) APPARATUS AND METHOD FOR STABLY DETACHING A DEVELOPING UNIT ON AN IMAGE FORMING APPARATUS

(71) Applicant: CANON KABUSHIKI KAISHA, Tokyo (JP)

(72) Inventors: Ryota Shibuya, Yokohama (JP); Masatoshi Takiguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/654,592

(22) Filed: Jul. 19, 2017

(65) Prior Publication Data

US 2018/0024494 A1 Jan. 25, 2018

(30) Foreign Application Priority Data

Jul. 22, 2016 (JP) ..... 2016-144643
Jul. 22, 2016 (JP) ..... 2016-144644

(51) Int. Cl.
*G03G 21/18* (2006.01)
*G03G 21/16* (2006.01)

(52) U.S. Cl.
CPC ..... *G03G 21/185* (2013.01); *G03G 21/1619* (2013.01); *G03G 21/1638* (2013.01); *G03G 21/1676* (2013.01); *G03G 21/1825* (2013.01); *G03G 21/1633* (2013.01); *G03G 21/1814* (2013.01); *G03G 2221/1684* (2013.01); *G03G 2221/1687* (2013.01)

(58) Field of Classification Search
CPC ..... G03G 21/185; G03G 21/1619; G03G 21/1676; G03G 21/1825; G03G 21/1633; G03G 2221/1684; G03G 2221/1687
See application file for complete search history.

(56) References Cited

U.S. PATENT DOCUMENTS

2011/0311272 A1* 12/2011 Nittani ..... G03G 21/1821 399/111
2014/0086627 A1* 3/2014 Tanabe ..... G03G 21/185 399/111
2017/0108826 A1* 4/2017 Yokoi ..... G03G 21/1814

FOREIGN PATENT DOCUMENTS

JP 2009-31771 A 2/2009
JP 2013-250389 A 12/2013
JP 2015-194563 A 11/2015
(Continued)

*Primary Examiner* — Sandra Brase

(74) *Attorney, Agent, or Firm* — Canon U.S.A., Inc. IP Division

(57) ABSTRACT

An image forming apparatus includes a supporting member configured to support a developing unit and be movable between a first position and a second position, an opening/closing member configured to open and close an opening through which the developing unit passes when the developing unit is attached to or detached from the supporting member, and a restriction member configured to restrict a movement of the supporting member from a third position different from the first and second positions, wherein in case where the opening/closing member is opened when the supporting member is at the first position, the restriction member presses the supporting member to move to the third position, and in case where the opening/closing member is opened when the supporting member is at the second position, the restriction member presses the supporting member to move to the third position.

22 Claims, 25 Drawing Sheets

(56) References Cited

FOREIGN PATENT DOCUMENTS

| | | | |
|---|---|---|---|
| JP | 2016-110122 | A | 6/2016 |
| JP | 2016-110141 | A | 6/2016 |

* cited by examiner

APPARATUS AND METHOD FOR STABLY DETACHING A DEVELOPING UNIT ON AN IMAGE FORMING APPARATUS

BACKGROUND OF THE INVENTION

Field of the Invention

The present disclosure relates to an image forming apparatus using an electrophotographic method, such as an electrophotographic copying machine, an electrophotographic printer (a light-emitting diode (LED) printer and a laser beam printer), a facsimile apparatus, and a word processor.

Description of the Related Art

Conventionally, an image forming apparatus employs a configuration in which a developing roller and a toner accommodating portion are included in a cartridge so that the developing roller and the toner accommodating portion can be attached and detached in a unified manner as a developing unit to and from the image forming apparatus. Such a cartridge method is used, whereby a user themselves can maintain the image forming apparatus without depending on a serviceman. Thus, it is possible to remarkably improve operability.

Japanese Patent Application Laid-Open No. 2016-110122 discusses a configuration in which a developing unit can be moved in an apparatus main body, and the developing unit can be moved to the position where toner can be supplied to a photosensitive drum, and the position where a developing roller is further retracted from the photosensitive drum than at the above position. According to this configuration, it is possible to prolong the lives of the developing roller and the photosensitive drum and stabilize image quality.

In terms of usability, it is desirable that the configuration should be such that when a user detaches the developing unit from the apparatus main body, the developing unit can be stably detached.

SUMMARY OF THE INVENTION

The present disclosure is directed to stably detaching a developing unit.

According to an aspect of the present disclosure, an image forming apparatus includes a supporting member configured to support a developing unit including a developing roller and be movable between a first position where the developing roller can attach toner to a photosensitive member, and a second position where the developing roller is separate from the photosensitive member so that the developing roller does not attach toner to the photosensitive member, an opening/closing member configured to open and close an opening through which the developing unit passes when the developing unit is attached to or detached from the supporting member, and a restriction member configured to restrict a movement of the supporting member from a third position different from the first and second positions, wherein in case where the opening/closing member is opened when the supporting member is at the first position, the restriction member presses the supporting member to move to the third position, and in case where the opening/closing member is opened when the supporting member is at the second position, the restriction member presses the supporting member to move to the third position.

Further features of the present disclosure will become apparent from the following description of exemplary embodiments with reference to the attached drawings.

DESCRIPTION OF THE EMBODIMENTS

Figure 1:
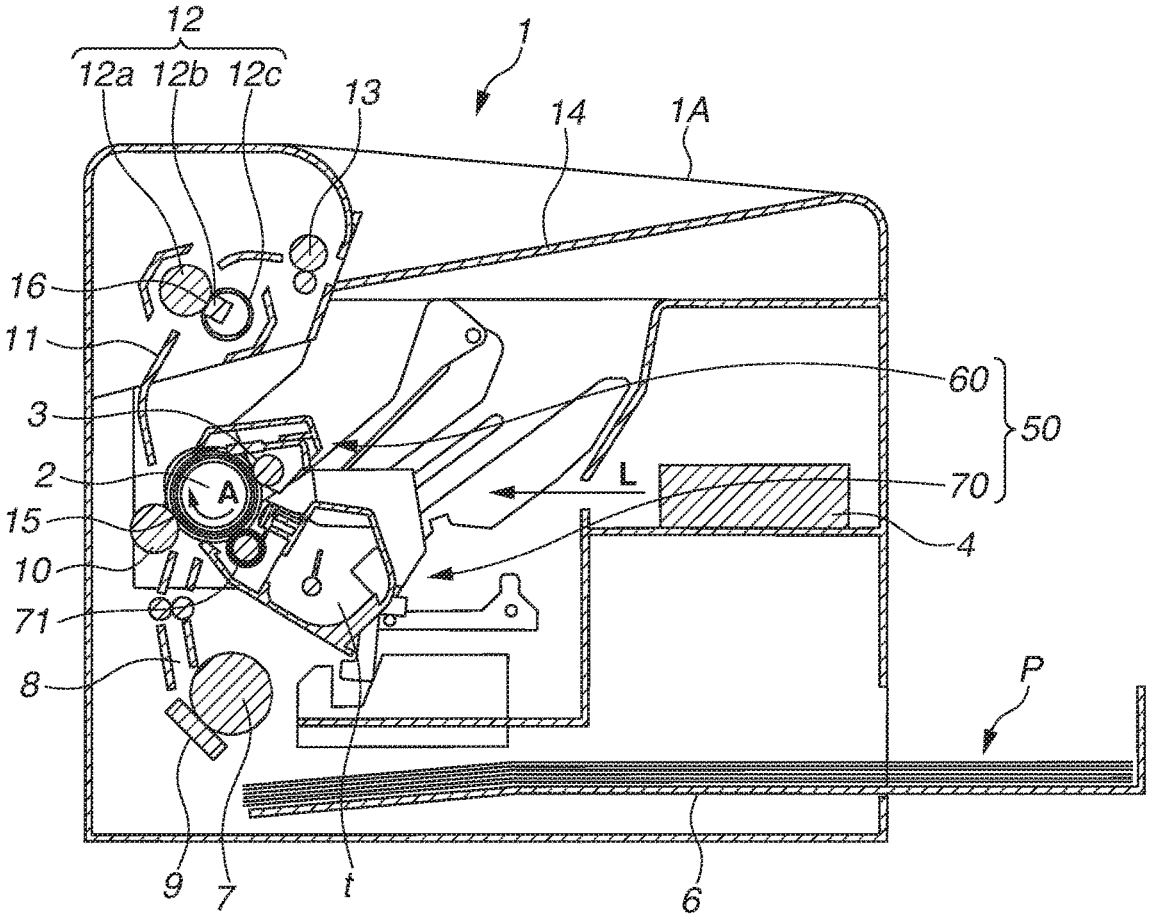
FIG. 1 is a cross-sectional view of an image forming apparatus and a cartridge.

First, with reference to FIG. 1, the overall configuration of a first exemplary embodiment is described. An image forming apparatus 1 illustrated in FIG. 1 forms an image on a recording medium P (e.g., a recording sheet, an overhead projector (OHP) sheet, or cloth) using a developer by an electrophotographic image forming process according to image information from an external device, such as a personal computer, connected to the image forming apparatus 1 so that the external device can communicate with the image forming apparatus 1.

FIG. 1 illustrates the state where a cartridge 50, which includes a drum cartridge 60 and a developing cartridge 70, is attached to an apparatus main body 1A. In the state where the cartridge 50 is attached, a rotating shaft of a photosensitive drum 2 is parallel to a rotating shaft of a developing roller 71. In the apparatus main body 1A and the cartridge 50, in the directions of the rotational axes of the photosensitive drum (photosensitive member) 2 and the developing roller 71, one end side where a coupling (a drive input portion 2*a*) for transmitting a driving force from the apparatus main body 1A to the photosensitive drum 2 and the developing roller 71 is placed is a driving side, and the other end side is a non-driving side. The longitudinal direction of the drum cartridge 60 is parallel to the rotating shaft of the photosensitive drum 2. The longitudinal direction of the developing cartridge 70 is parallel to the rotating shaft of the developing roller 71.

(Configuration of Image Forming Apparatus)

With reference to FIG. 1, the structure of the image forming apparatus 1 is described. The photosensitive drum 2 rotates in the direction of an arrow A, whereby the surface of the photosensitive drum 2 is uniformly charged by a charging roller 3 serving as a charging unit. An optical unit (exposure unit) 4 irradiates the photosensitive drum 2 with laser light L according to image information, thereby forming an electrostatic latent image according to the image information on the photosensitive drum 2. The electrostatic latent image formed on the photosensitive drum 2 is developed by the developing roller 71 serving as a developing unit and using toner t, thereby forming a toner image.

Meanwhile, in synchronization with the formation of the toner image, recording media P, which are set in a feeding cassette 6, are separated and fed one by one by a pickup roller 7 and a pressure contact member 9, which comes into pressure contact with the pickup roller 7. Then, each recording medium P is conveyed along a conveyance guide 8 to a transfer roller 10 serving as a transfer unit. Next, the recording medium P passes through a transfer nip portion 15, which is formed by the photosensitive drum 2 and the transfer roller 10 to which a certain voltage is applied. At this time, the toner image formed on the photosensitive drum 2 is transferred onto the recording medium P. The recording medium P onto which the toner image has been transferred is conveyed to a fixing unit 12 by a conveyance guide 11. The fixing unit 12 includes a driving roller 12*a* and a fixing roller 12*c*, into which a heater 12*b* is built. Heat and pressure are applied to the recording medium P passing through a nip portion 16, which is formed by the fixing roller 12*c* and the driving roller 12*a*, thereby fixing the transferred toner image to the recording medium P. Then, the recording medium P is conveyed by a discharge roller pair 13 and discharged to a discharge tray 14.

(Configuration of Cartridge)

Figure 2:
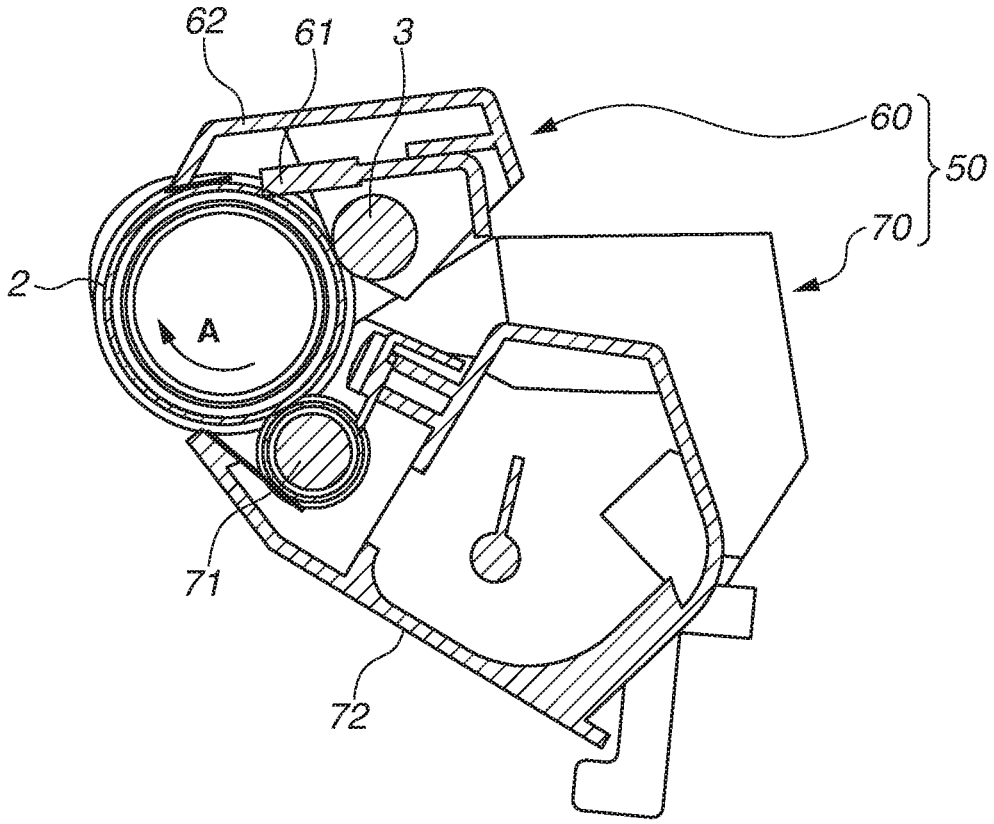
FIG. 2 is a cross-sectional view of the cartridge.
Figure 3:
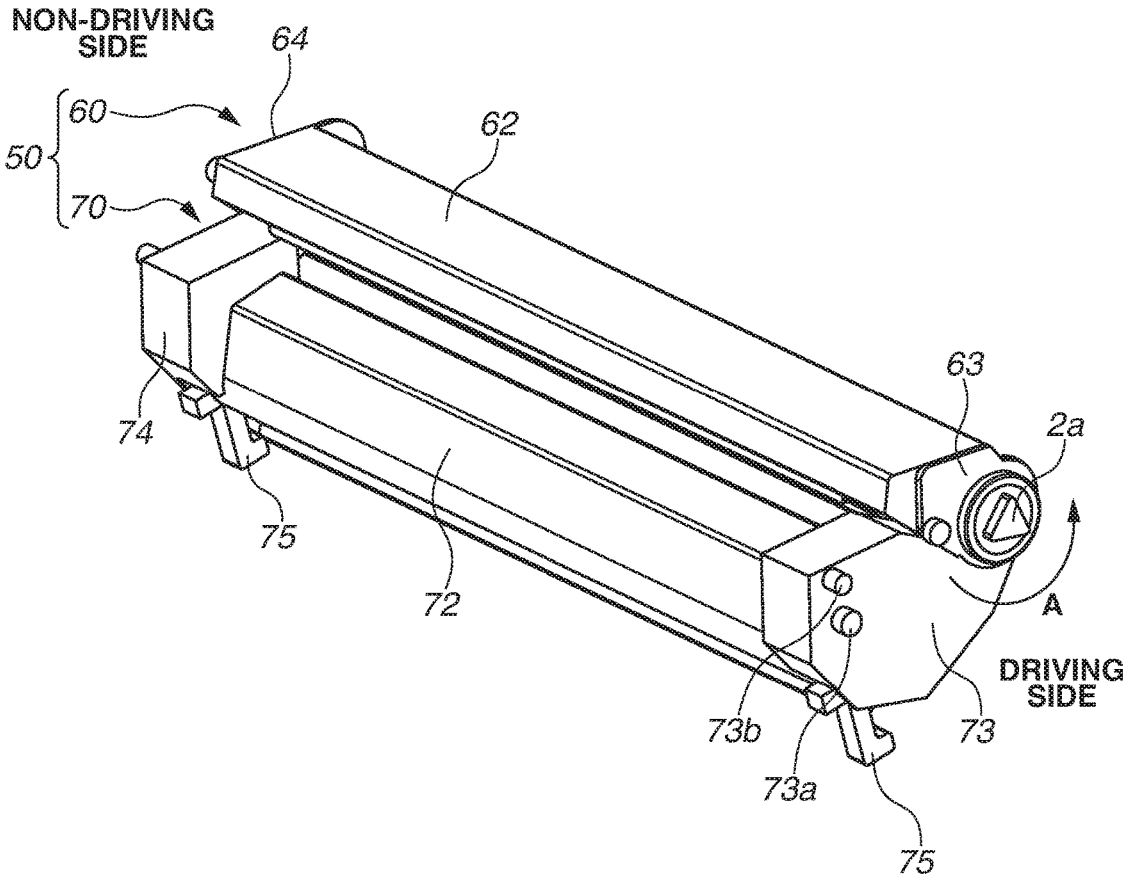
FIG. 3 is a perspective view of the cartridge.

Next, with reference to FIGS. 2 and 3, a description is given of the cartridge 50, which is attachable to and detachable from the apparatus main body 1A of the image forming apparatus 1 according to the present exemplary embodiment. FIG. 2 is a schematic cross-sectional view illustrating the configuration of the cartridge 50. As illustrated in FIG. 2, the cartridge 50 includes a drum cartridge 60, which includes a photosensitive drum 2, a charging roller 3, and a cleaning blade 61, and a developing cartridge 70, which includes a developing roller 71. A user can individually attach and detach each of the drum cartridge 60 and the developing cartridge 70 to and from the apparatus main body 1A. The drum cartridge 60 can be attached to and detached from the apparatus main body 1A by moving in a direction intersecting (a direction orthogonal to, in the present exemplary embodiment) the longitudinal direction of the drum cartridge 60. The developing cartridge 70 can be attached to and detached from the apparatus main body 1A by moving in a direction intersecting (a direction orthogonal to, in the present exemplary embodiment) the longitudinal direction of the developing cartridge 70.

FIG. 3 illustrates a perspective view of the cartridge 50, which includes the drum cartridge 60 and the developing cartridge 70. A cleaning frame member 62 of the drum cartridge 60 is rotatably supported by the photosensitive drum 2 through a driving-side drum bearing 63 and a non-driving-side drum bearing 64. A drive input portion 2*a*, which is provided in an end portion on the driving side in the longitudinal direction of the photosensitive drum 2, is configured to be engaged with a drive output portion (not illustrated) of the apparatus main body 1A and receive the driving force of a driving motor (not illustrated) of the apparatus main body 1A. Consequently, the photosensitive drum 2 is driven to rotate in the direction of an arrow A according to an image forming operation (see FIG. 2). The drive input portion 2*a* is a coupling in the shape of a slightly twisted triangular prism and is engaged with a drive transmission portion (a main-body-side coupling) (not illustrated) provided in the apparatus main body 1A. However, the shapes of the drive input portion 2*a* and the drive transmission portion of the apparatus main body 1A are not limited to these. A development frame member 72 of the developing cartridge 70 includes a driving-side development bearing 73 and a non-driving-side development bearing 74, which rotatably support the developing roller 71. Further, the developing cartridge 70 includes pressing target portions 75.

(Configuration of Guide Unit of Cartridge)

Figure 4:
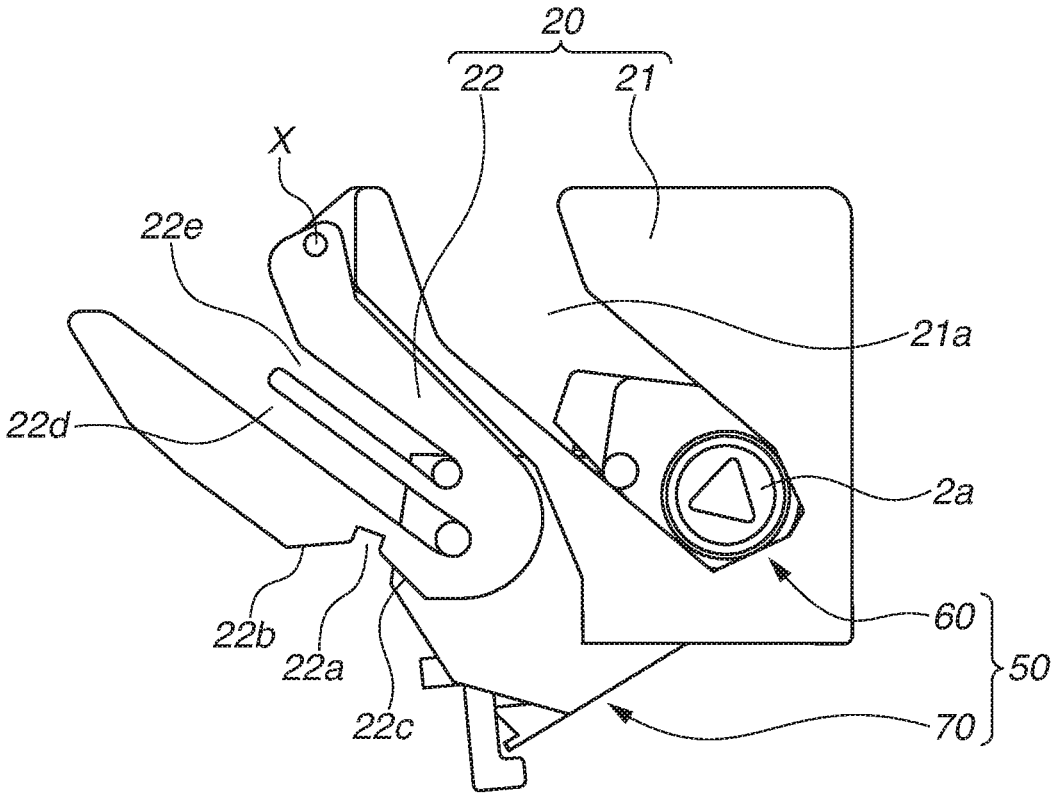
FIG. 4 is a side view of the cartridge and a cartridge guide.

Next, with reference to FIG. 4, a description is given of the configuration of a guide unit used when the cartridge 50 is attached to or detached from the apparatus main body 1A. FIG. 4 is a side view of the cartridge 50 and a cartridge guide 20 in the state where the cartridge 50 is attached to the apparatus main body 1A. Cartridge guides 20, which are guide units for guiding the cartridge 50, are included on the driving side and the non-driving side in the apparatus main body 1A and have shapes opposite to each other. Although FIG. 4 illustrates the cartridge guide 20 on the driving side, the guide 20 shaped symmetrically to the guide 20 on the driving side is also provided on the non-driving side. The configuration of the guide 20 on the non-driving side is similar to that of the guide 20 on the driving side, and therefore is not described here.

As described above, the cartridge 50 is divided into the drum cartridge 60 and the developing cartridge 70. As illustrated in FIG. 4, in the apparatus main body 1A, a cartridge guide 20 is provided, which is a guide unit used when the cartridge 50 is attached to the inside of the apparatus main body 1A. This cartridge guide 20 is included on each of the driving side and the non-driving side in the apparatus main body 1A. Further, the cartridge guide 20 includes a fixed guide 21 and a movable guide 22. The fixed guide 21 is fixed in the apparatus main body 1A and includes a guide groove 21*a*, into which the drive input portion 2*a* is inserted, as a guide unit for guiding the movement of the drum cartridge 60 when the drum cartridge 60 is attached to the inside of the apparatus main body 1A. The movable guide 22 is supported by the fixed guide 21 so as to be rotatable about a pivotal axis X, which serves as a movable guide rotating shaft and a fixed guide rotating shaft. The movable guide 22 includes a guide groove 22*d*, into which a boss 73*a* is inserted, and a guide groove 22*e*, into which a boss 73*b* is inserted, as guide portions for guiding the movement of the developing cartridge 70 when the developing cartridge 70 is attached to the inside of the apparatus main body 1A. The movable guide 22 is a supporting member for supporting the developing cartridge 70 and can move (rotate about the pivotal axis X) in a unified manner with the cartridge 70 in the state where the movable guide 22 supports the developing cartridge 70. Further, the movable guide 22 includes a restriction groove 22*a* and guiding surfaces 22*b* and 22*c*.

(Operation of Contact and Separation of Cartridge)

Figure 5A:
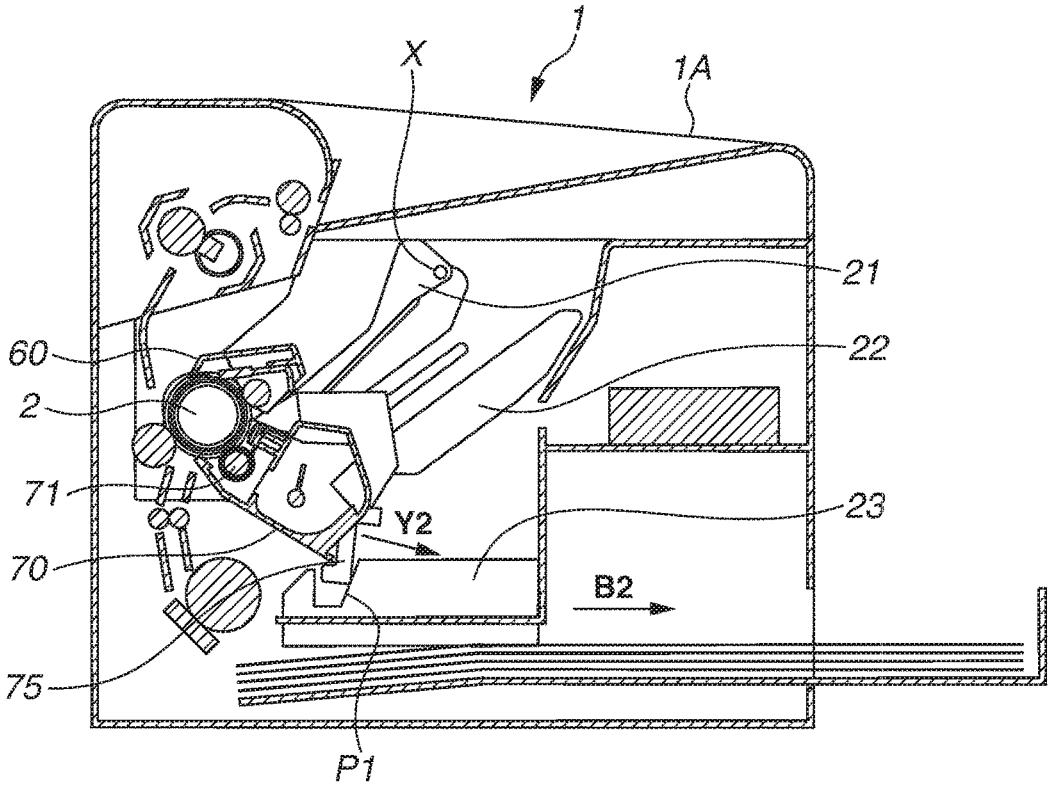
FIG. 5A is a cross-sectional view of the image forming apparatus, illustrating a contact state of the cartridge.
Figure 5B:
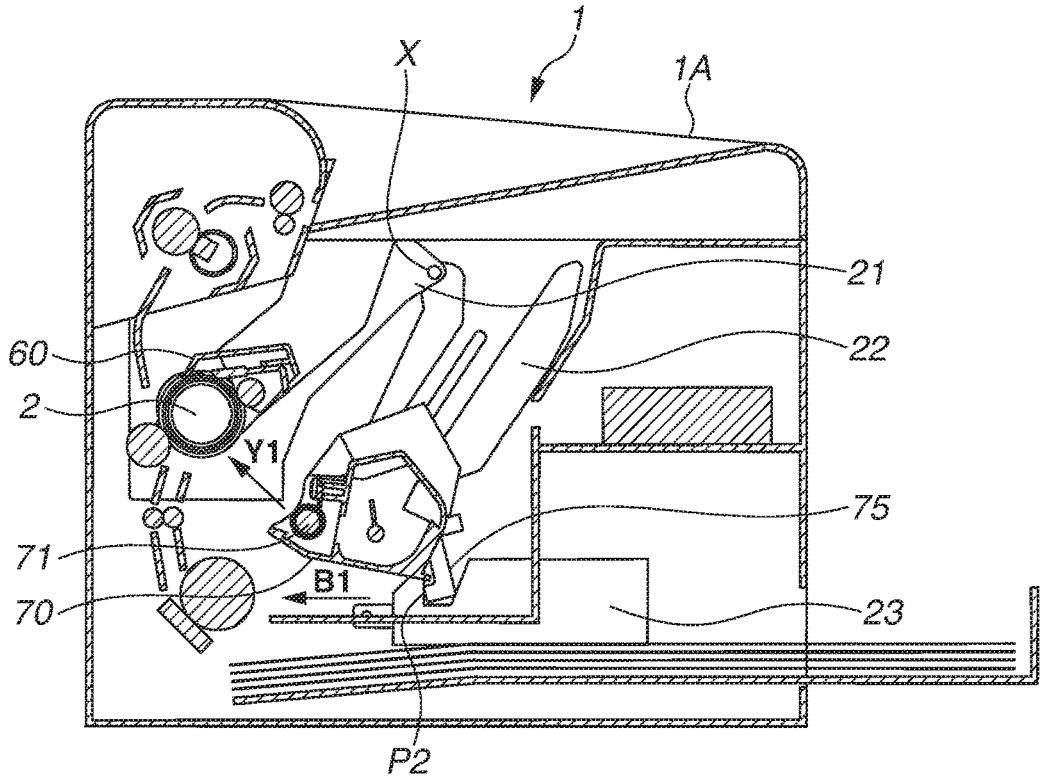
FIG. 5B is a cross-sectional view of the image forming apparatus, illustrating a separate state of the cartridge.

Next, a description is given of the contact and separation of the photosensitive drum 2 and the developing roller 71 of the cartridge 50. In the image forming apparatus 1, only when an image is transferred onto the recording medium P, the photosensitive drum 2 and the developing roller 71 are in contact with each other. In other cases, the photosensitive drum 2 and the developing roller 71 are separate from each other. FIGS. 5A and 5B illustrate this contact and separation. FIGS. 5A and 5B illustrate the state where the drum cartridge 60 is attached to the fixed guide 21, and the developing cartridge 70 is attached to the movable guide 22. FIG. 5A is a cross-sectional view illustrating a contact state of the cartridge 50. In the state illustrated in FIG. 5A, a moving member 23 is at a first pressing position and presses the pressing target portion 75 of the developing cartridge 70 on a first pressing surface P1. At this time, the movable guide 22 is at a first position, the developing cartridge 70 is at a development position, the photosensitive drum 2 and the developing roller 71 are in contact with each other, and the toner t borne on the surface of the developing roller 71 can be attached to the surface of the photosensitive drum 2.

FIG. 5B is a cross-sectional view illustrating a separate state of the cartridge 50. In the state illustrated in FIG. 5B, the moving member 23 is at a second pressing position and presses the pressing target portion 75 of the developing cartridge 70 on a second pressing surface P2. At this time, the movable guide 22 is at a second position different from the first position, and the photosensitive drum 2 and the developing roller 71 are separate from each other. That is, at this time, the developing cartridge 70 is at a separate position, and the toner t borne on the surface of the developing roller 71 cannot be attached to the surface of the photosensitive drum 2. As described above, when the developing cartridge 70 is at the separate position, the developing roller 71 is at a position further away from the photosensitive drum 2 than when the developing cartridge 70 is at the development position.

If a job signal is input to the apparatus main body 1A, a driving source (not illustrated) of the apparatus main body 1A moves the moving member 23 in the direction of an arrow B1. Then, the moving member 23 biases the pressing target portion 75 supported by the developing cartridge 70, and this biasing force is transmitted to the developing cartridge 70 through a pressure spring (not illustrated). As a result, the developing cartridge 70 receiving the biasing force pivots in a unified manner with the movable guide 22 about a rotation center X of the movable guide 22 in the direction of an arrow Y1. Then, as illustrated in FIG. 5A, the developing roller 71 and the photosensitive drum 2 come into contact with each other. Then, a toner image becomes able to be formed on the photosensitive drum 2. After the operation of forming the toner image on the photosensitive drum 2 ends, the moving member 23 moves in the direction of an arrow B2 and biases the pressing target portion 75 to move the developing cartridge 70 so that the developing roller 71 separates from the photosensitive drum 2. Consequently, the developing cartridge 70 and the movable guide 22 pivot about the rotation center X in the direction of an arrow Y2. Then, as illustrated in FIG. 5B, the developing roller 71 is further away from the photosensitive drum 2 than in the state illustrated in FIG. 5A.

(Operation when Opening/Closing Member 24 is Opened)

Next, a description is given of the operation when the cartridge 50 is attached or detached. In the image forming apparatus 1, in a case where the recording medium P is jammed in the apparatus main body 1A, or in a case where the toner t in the cartridge 50 is used up, the user needs to open an opening/closing member 24 at a closed position to an opened position and perform the operation of taking out the cartridge 50 and the operation of attaching the cartridge 50. When the user opens the opening/closing member 24, then in the apparatus main body 1A, there is a case where the cartridge 50 stops in the contact state, or a case where the cartridge 50 stops in the separate state. In response, a description is given of how to move the movable guide 22 when opening the opening/closing member 24 in a case where the cartridge 50 is in the contact state and in a case where the cartridge 50 is in the separate state.

Figure 6A:
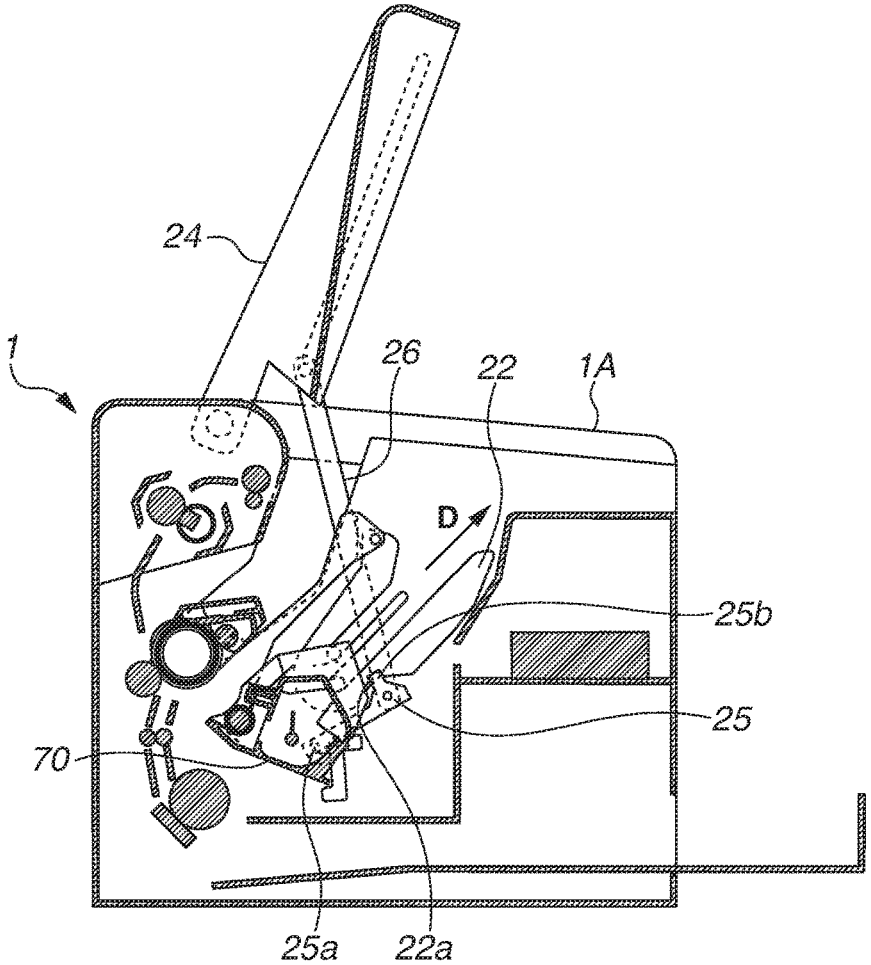
FIG. 6A is a cross-sectional view of the image forming apparatus in a state where an opening/closing member is opened.
Figure 6B:
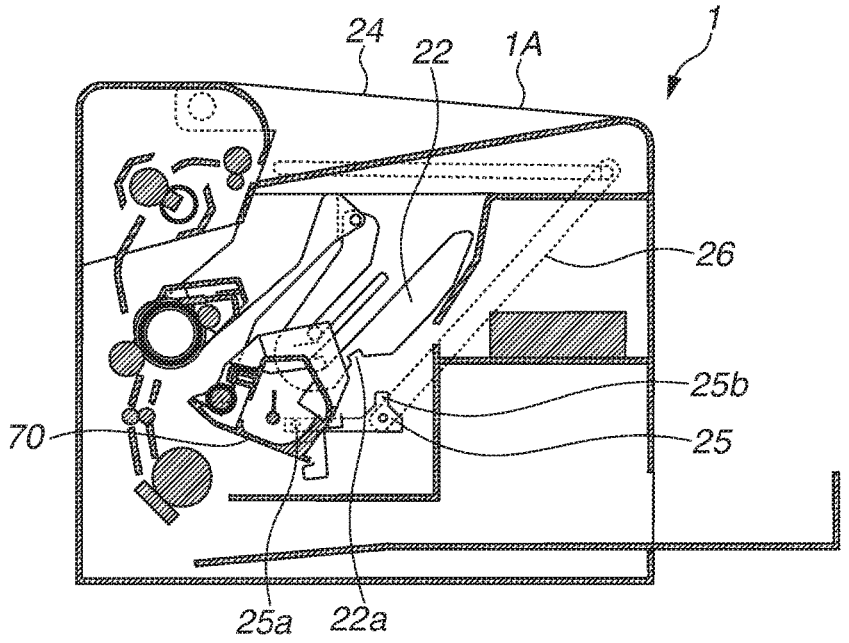
FIG. 6B is a cross-sectional view of the image forming apparatus in a state where the opening/closing member is closed.

FIGS. 6A and 6B are cross-sectional views of the image forming apparatus 1, as viewed from the non-driving side to the driving side. FIG. 6A illustrates the state where the opening/closing member 24 is opened. FIG. 6B illustrates the state where the opening/closing member 24 is closed after being opened.

The apparatus main body 1A includes an opening/closing member 24, which opens and closes an opening through which the cartridge 50 passes when the cartridge 50 is attached to or detached from the cartridge guide 20. In the opening/closing member 24, the user performs the operation of opening the opening/closing member 24 when detaching the cartridge 50. Then, the user attaches the cartridge 50 and performs the operation of closing the opening/closing member 24.

Further, the apparatus main body 1A includes a restriction member 25, which pivots about a pivotal center 25*a* in conjunction with the opening and closing operation of the opening/closing member 24, and a first link member 26, which is linked to the opening/closing member 24 and the restriction member 25. As illustrated in FIG. 6A, if the opening/closing member 24 opens, the restriction member 25 pivots through the first link member 26 in the direction in which the restriction member 25 comes close to the movable guide 22, and a protruding portion (engagement portion) 25*b* of the restriction member 25 becomes inserted into and engaged with the restriction groove (engagement target portion) 22*a* of the movable guide 22. Consequently, the restriction member 25 restricts the movement of the movable guide 22. Further, the configuration is such that the restriction member 25 and the opening/closing member 24 are linked together by the first link member (linking member) 26. Thus, as illustrated in FIG. 6B, if the opening/closing member 24 closes, the restriction member 25 pivots through the first link member 26 in a direction away from the movable guide 22, and the protruding portion 25*b* comes out of the restriction groove 22*a*. Thus, the restriction of the movement of the movable guide 22 is lifted. FIGS. 6A and 6B illustrate the restriction member 25 engaged with the movable guide 22, and the first link member 26 on the non-driving side. However, the configuration is such that also on the driving side, a similar restriction member 25 to be engaged with the movable guide 22, and a similar first link member 26 are provided, and similarly to the non-driving side, operated in conjunction with the opening and closing operation of the opening/closing member 24.

Figure 15A:
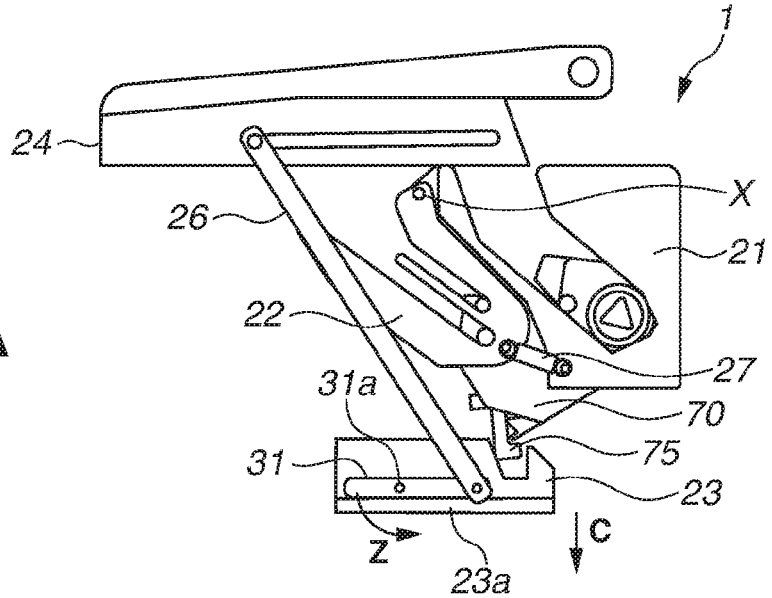
FIG. 15A is a side view of the opening/closing member, the cartridge, the cartridge guide, and a contact/separation slide.
Figure 15B:
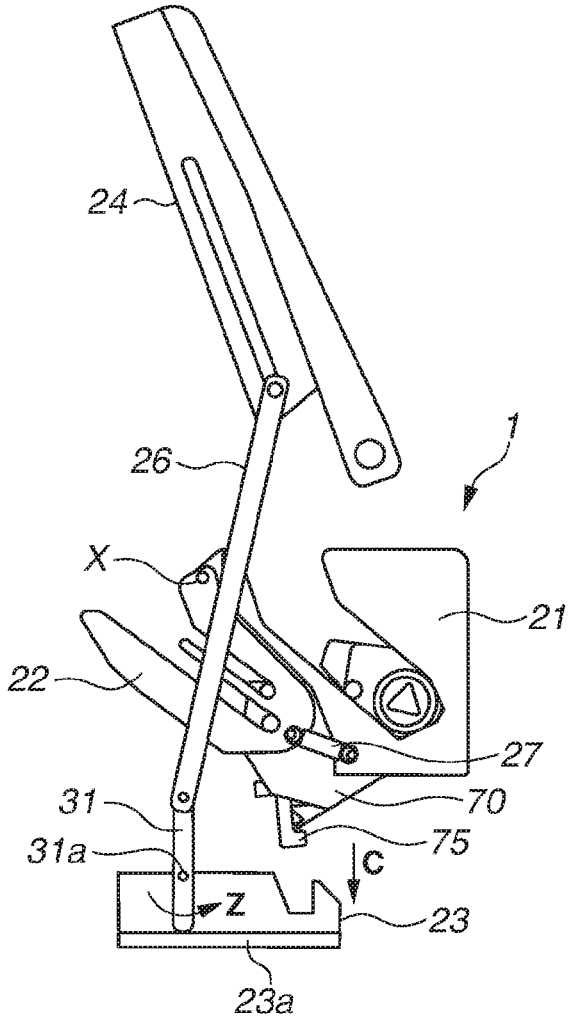
FIG. 15B is a side view of the opening/closing member, the cartridge, the cartridge guide, and the contact/separation slide.

Further, the configuration is such that the moving member 23 retracts in conjunction with the opening and closing operation of the opening/closing member 24. This operation is described. FIGS. 15A and 15B are cross-sectional views of the image forming apparatus 1, as viewed from the driving side to the non-driving side. FIG. 15A illustrates the state where the opening/closing member 24 is closed. FIG. 15B illustrates the state where the opening/closing member 24 is opened. The apparatus main body 1A includes a second link member 31, which pivots about a rotation center 31*a* in conjunction with the opening and closing operation of the opening/closing member 24. The second link member 31 is linked to the first link member 26. As illustrated in FIG. 15B, the second link member 31 pivots in the direction of an arrow Z by the movement of the first link member 26 when the opening/closing member 24 opens. Then, the second link member 31 pushes down a pressing target surface 23*a* of the moving member 23 in the direction of an arrow C. Consequently, when the opening/closing member 24 is in a closed state, and even in a case where the moving member 23 and the pressing target portion 75 of the cartridge 50 are engaged together, the engagement between the moving member 23 and the pressing target portion 75 is released. Then, regardless of which of positions including the contact state and the separate state the cartridge 50 is at in the apparatus main body 1A, when the opening/closing member 24 opens, the second link member 31 pushes down the moving member 23 in the direction of the arrow C and can release the engagement between the moving member 23 and the pressing target portion 75. FIGS. 15A and 15B illustrate the movable guide 22, the first link member 26, the second link member 31, and the moving member 23 on the driving side. However, the configuration is such that also on the non-driving side, a similar movable guide 22, a similar first link member 26, a similar second link member 31, and a similar moving member 23 are provided, and similarly to the driving side, operated in conjunction with the opening and closing operation of the opening/closing member 24. As described above, on each side, the first link member 26 is linked not only to the restriction member 25 but also to the second link member 31.

(Case where Opening/Closing Member 24 is Opened when Cartridge 50 is in Contact State)

Figure 7:
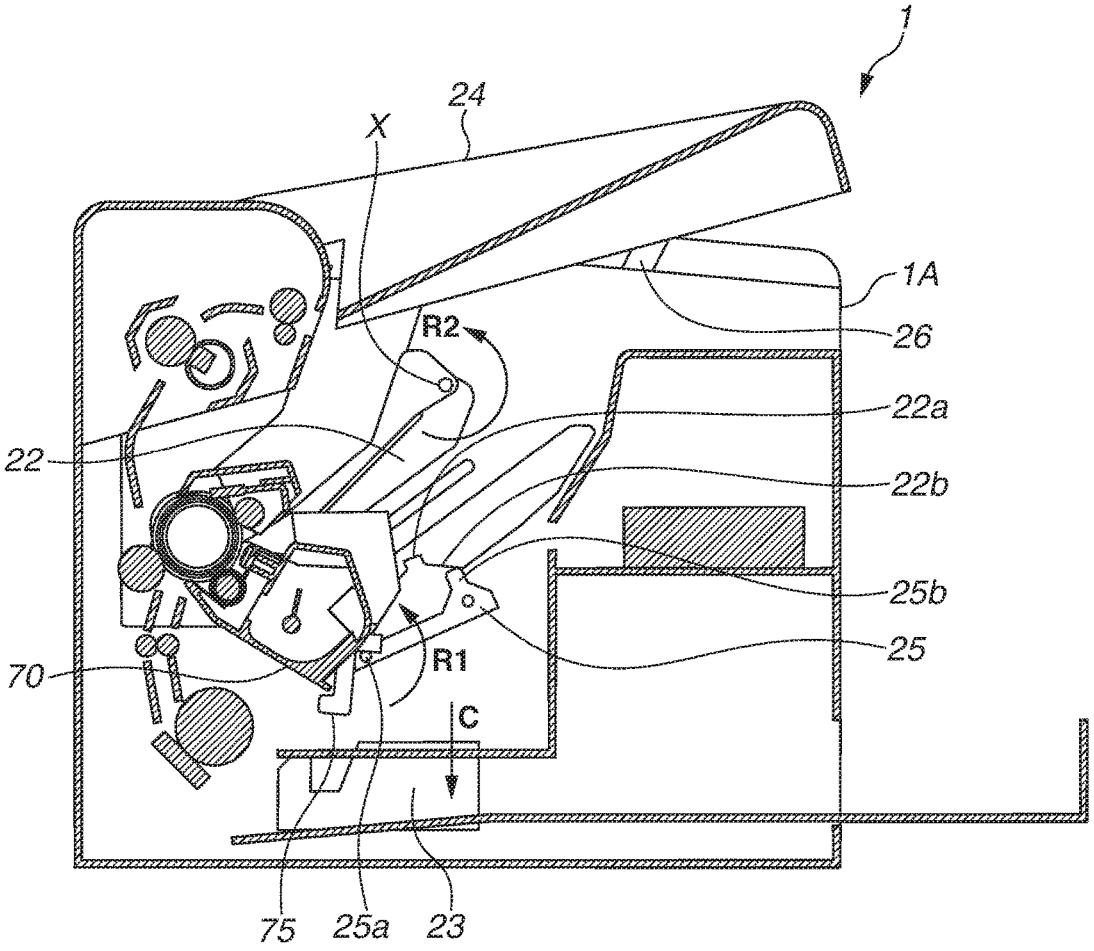
FIG. 7 is a cross-sectional view of the image forming apparatus, illustrating the middle of opening the opening/closing member.

FIG. 7 is a cross-sectional view of the image forming apparatus 1, illustrating the middle of opening the opening/closing member 24 when the cartridge 50 is in the contact state, as viewed from the non-driving side to the driving side. If the formation of an image on a recording material ends, the operation of the apparatus main body 1A stops with the cartridge 50 in the separate state. However, in a case where the recording medium P is jammed in the apparatus main body 1A, the operation of the apparatus main body 1A stops with the cartridge 50 in the contact state. In this case, the opening/closing member 24 is opened when the cartridge 50 is in the contact state. If the user opens the opening/closing member 24 in this stopped state, the first link member 26 moves. Consequently, first, the second link member 31 moves the moving member 23 in the direction of an arrow C, and the engagement between the moving member 23 and the pressing target portion 75 is released. As a result, the developing cartridge 70 becomes able to pivot together with the movable guide 22 about a rotating shaft X of the movable guide 22. Further, if the user continues to open the opening/closing member 24, then as illustrated in FIG. 7, the restriction member 25 receives a force from the first link member 26 and pivots in the direction of an arrow R1 in which the restriction member 25 comes close to the movable guide 22 from a non-restriction position. Then, the restriction member 25 comes into contact with the guiding surface (first force reception portion) 22*b* of the movable guide 22. The guiding surface 22*b* receives a pressing force from the restriction member 25, whereby the movable guide 22 rotates in the direction of an arrow R2 until the protruding portion 25*b* becomes engaged with the restriction groove 22*a*. This results in the state illustrated in FIG. 6A. At this time, the restriction member 25 is at a restriction position, the pivoting of the movable guide 22 about the rotating shaft X is restricted, and the position of the movable guide 22 is determined. Thus, it can be said that at this time, the cartridge 50 is at a detachment position where the cartridge 50 can be detached, and the movable guide 22 is at an attachment/detachment position (a predetermined third position) where the cartridge 50 can be attached and detached. At this time, the movement of the cartridge 50 in directions other than a detachment direction D is restricted. The detachment direction D is parallel to the direction in which the guide grooves 22*d* and 22*e* extend when the movable guide 22 is at the attachment/detachment position.

(Case where Opening/Closing Member 24 is Opened when Cartridge 50 is in Separate State)

Figure 8:
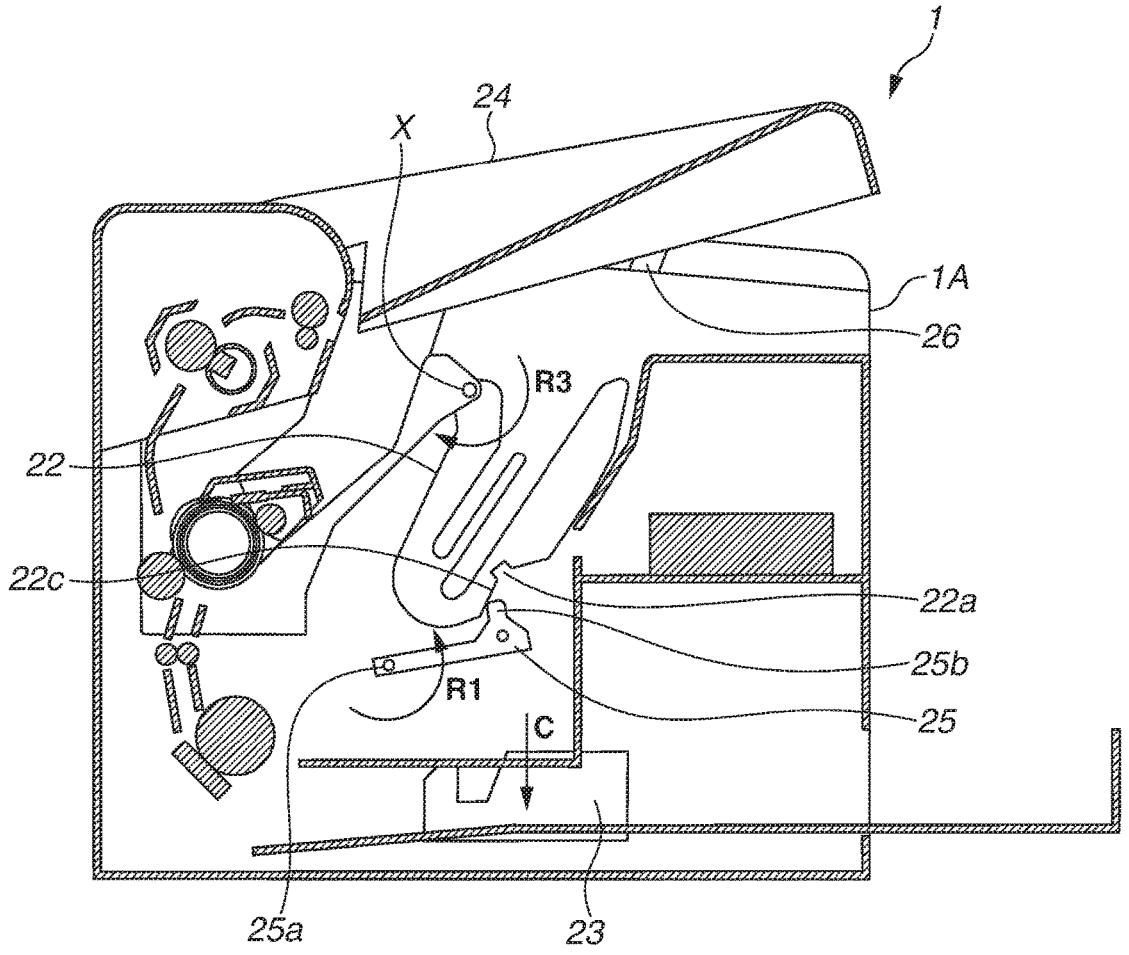
FIG. 8 is a cross-sectional view of the image forming apparatus, illustrating the middle of opening the opening/closing member.

FIG. 8 is a cross-sectional view of the image forming apparatus 1, illustrating the state where the cartridge 50 stops in the separate state, as viewed from the non-driving side to the driving side. In FIG. 8, for illustrative purposes, the developing cartridge 50 is not illustrated. If the formation of an image on a recording material ends, the operation of the apparatus main body 1A stops with the cartridge 50 in the separate state. In this case, the opening/closing member 24 is opened when the cartridge 50 is in the separate state. If the user opens the opening/closing member 24 in this stopped state, the first link member 26 moves. Consequently, first, the second link member 31 moves the moving member 23 in the direction of an arrow C, and the engagement between the moving member 23 and the pressing target portion 75 is released. As a result, the developing cartridge 70 becomes able to pivot together with the movable guide 22 about a rotating shaft X of the movable guide 22. Further, if the user continues to open the opening/closing member 24, then as illustrated in FIG. 8, the restriction member 25 receives a force from the first link member 26 and pivots in the direction of an arrow R1 in which the restriction member 25 comes close to the movable guide 22 from a non-restriction position. Then, the restriction member 25 comes into contact with the guiding surface (second force reception portion) 22*c* of the movable guide 22. The guiding surface 22*c* receives a pressing force from the restriction member 25, whereby the movable guide 22 rotates in the direction of an arrow R3 until the protruding portion 25*b* becomes engaged with the restriction groove 22*a*. This results in the state illustrated in FIG. 6A. At this time, the restriction member 25 is at a restriction position, the pivoting of the movable guide 22 about the rotating shaft X is restricted, and the position of the movable guide 22 is determined. Thus, it can be said that at this time, the cartridge 50 is at a detachment position where the cartridge 50 can be detached, and the movable guide 22 is at an attachment/detachment position (a predetermined third position) where the cartridge 50 can be attached and detached. At this time, the movement of the cartridge 50 in directions other than a detachment direction D is restricted. The detachment direction D is parallel to the direction in which the guide grooves 22*d* and 22*e* extend when the movable guide 22 is at the attachment/detachment position.

As described above, the configuration is such that both when the cartridge 50 is in the contact state and when the cartridge 50 is in the separate state, and if the opening/closing member 24 is opened, the movable guide 22 receives a pressing force from the restriction member 25 and moves to a single attachment/detachment position between the first and second positions.

(Variation 1)

In the above exemplary embodiment, the movable guide 22 is moved to the attachment/detachment position by transmitting a force from the opening/closing member 24 to the first link member 26, the restriction member 25, and the second link member 31. Alternatively, the configuration may be such that a sensor for detecting the opening operation of the opening/closing member 24 is provided, and based on the fact that the sensor detects the opening operation of the opening/closing member 24, the restriction member 25 or the movable guide 22 is moved by a motor, thereby moving the movable guide 22 to the attachment/detachment position.

Figure 9A:
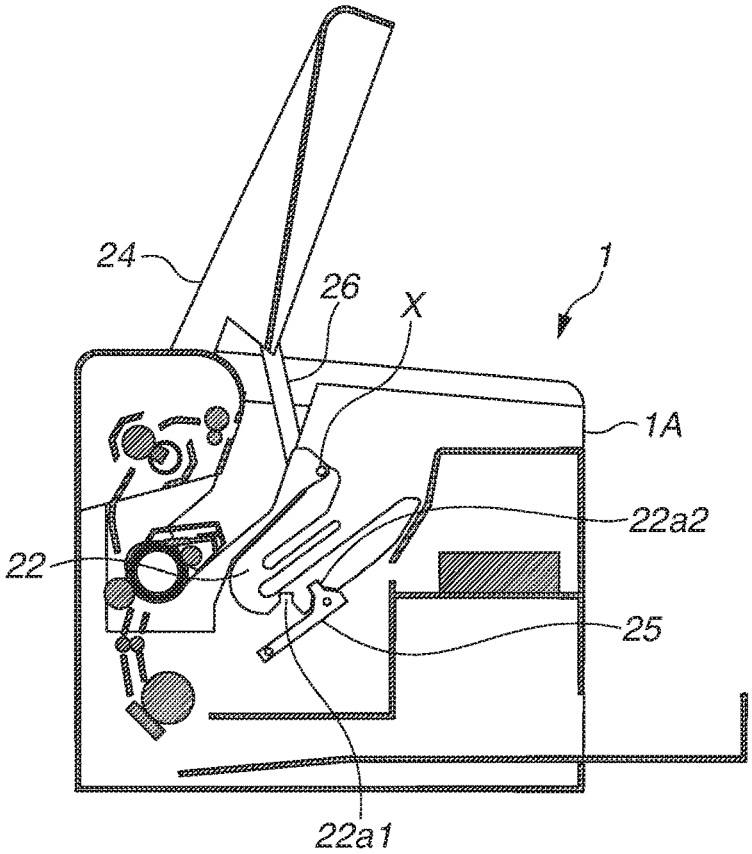
FIG. 9A is a cross-sectional view of the image forming apparatus in a state where the opening/closing member is opened.
Figure 9B:
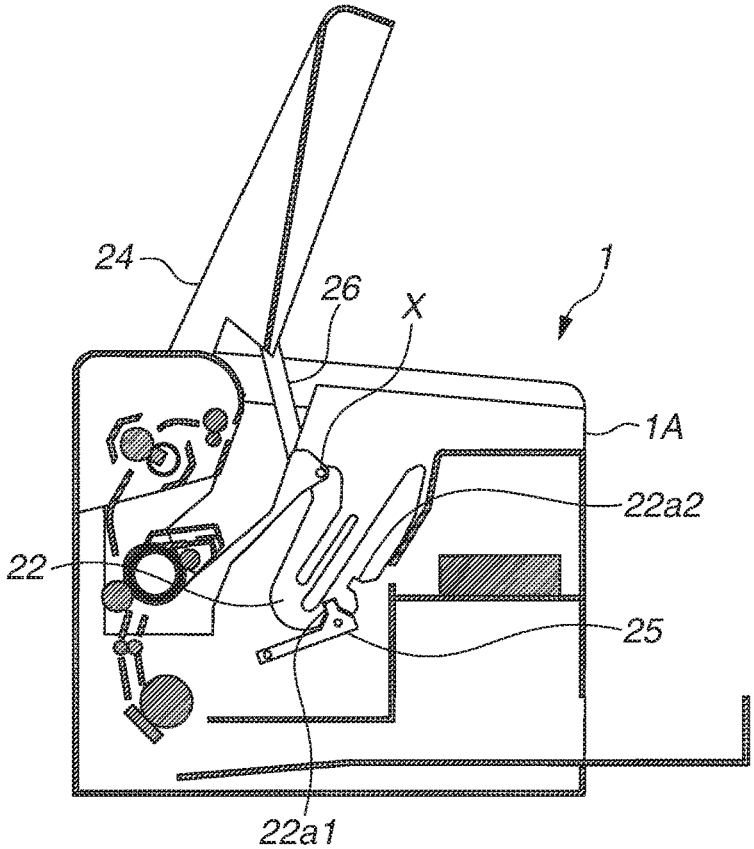
FIG. 9B is a cross-sectional view of the image forming apparatus in a state where the opening/closing member is opened.

Further, in the above exemplary embodiment, the configuration is such that if the opening/closing member 24 is opened, the movable guide 22 moves to a single attachment/detachment position, and then, the movement of the movable guide 22 is restricted by the restriction member 25. Alternatively, as illustrated in FIGS. 9A and 9B, two restriction grooves 22*a* may be provided in the movable guide 22, and two attachment/detachment positions may be provided. In FIGS. 9A and 9B, a first restriction groove 22*a*1 and a second restriction groove 22*a*2 are provided in the movable guide 22. On both sides of each of the two restriction grooves 22*a*1 and 22*a*2, guiding surfaces are provided. In a case where the opening/closing member 24 is opened when the cartridge 50 is in the separate state, then as illustrated in FIG. 9A, the restriction member 25 becomes engaged with the second restriction groove 22*a*2, and the position of the movable guide 22 is restricted at a second attachment/detachment position. In a case where the opening/closing member 24 is opened when the cartridge 50 is in the contact state, then as illustrated in FIG. 9B, the restriction member 25 becomes engaged with the first restriction groove 22*a*1, and the position of the movable guide 22 is restricted at a first attachment/detachment position. The first attachment/detachment position is set to a position closer to the first position than to the second position, and the second attachment/detachment position is set to a position closer to the second position than to the first position. According to such a configuration, the distance at which the movable guide 22 moves from when the opening operation of the opening/closing member 24 is started to when the position of the movable guide 22 is restricted at an attachment/detachment position can be shorter. Thus, it is possible to regulate the position of the movable guide 22 after the opening operation of the opening/closing member 24 is started and before the opening angle of the opening/closing member 24 becomes very great. Particularly, with the configuration in which the restriction member 25 or the movable guide 22 is moved to the attachment/detachment positions by a motor, it is possible to move the movable guide 22 to the attachment/detachment positions in a shorter time.

Summary of the First Exemplary Embodiment

According to the first exemplary embodiment, the configuration is such that if the opening/closing member 24 is opened, the pivoting of the movable guide 22 is restricted by the restriction member 25. According to this, it is possible to stably attach and detach the developing cartridge 70 to and from the movable guide 22. Thus, it is possible to improve the operability of attachment and detachment of the developing cartridge 70. Further, in a case where the attachment/detachment position of the movable guide 22 is a single position, and if the opening/closing member 24 is opened, the movable guide 22 moves to the single position, regardless of which position the developing cartridge 70 is at. Thus, it is only necessary to provide a single attachment/detachment path for the developing cartridge 70. Thus, it is possible to attach and detach the developing cartridge 70 even if an opening or a space through which the developing cartridge 70 passes when the developing cartridge 70 is attached to or detached from the apparatus main body 1A is not formed to be large in the apparatus main body 1A. This leads to downsizing of the apparatus main body 1A.

In the first exemplary embodiment, a description has been given of the image forming apparatus 1 to which the cartridge 50 including the drum cartridge 60 and the developing cartridge 70 is attached. In a second exemplary embodiment, a description is given of an image forming apparatus 1 to which a cartridge 80 configured as a process cartridge by unifying a drum unit 82 and a developing unit 83 is attached. The configuration of the image forming apparatus and the operation of the contact and separation of the cartridge described in the first exemplary embodiment are similar to those in the second exemplary embodiment, and therefore are not described here.

(Configuration of Cartridge)

Figure 10:
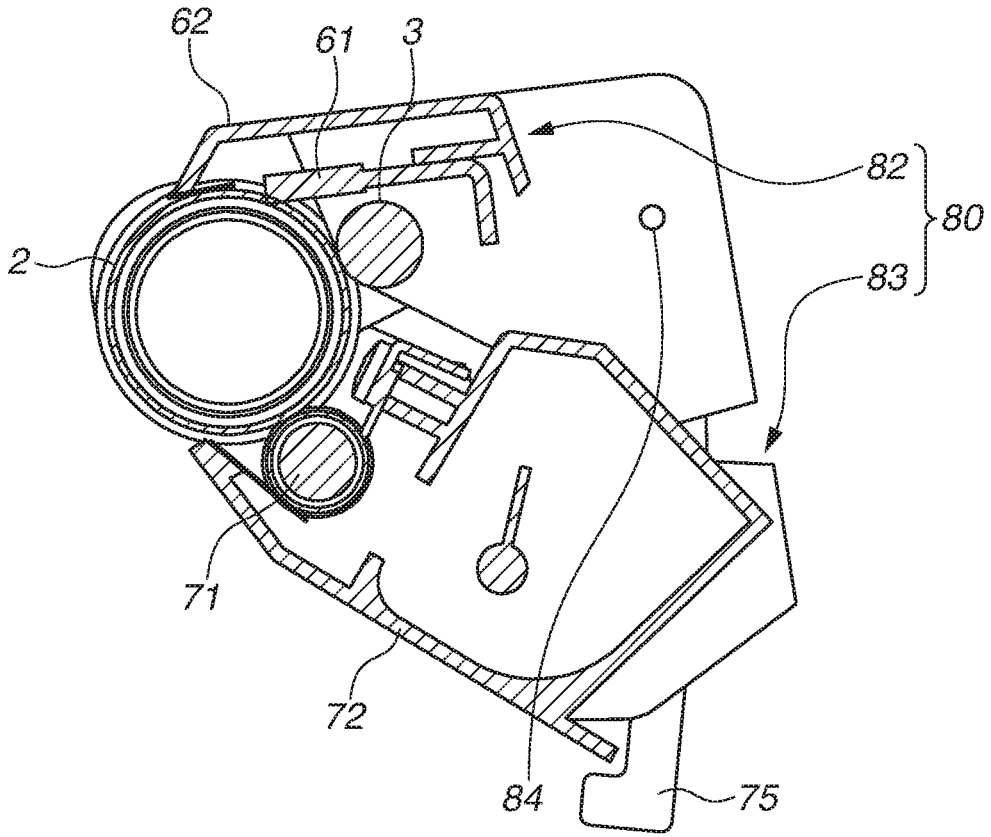
FIG. 10 is a cross-sectional view of a cartridge.

With reference to FIG. 10, a description is given of the cartridge 80, which is attachable to and detachable from the apparatus main body 1A of the image forming apparatus 1 according to the present exemplary embodiment. FIG. 10 is a schematic cross-sectional view illustrating the configuration of the cartridge 80. The cartridge 80 includes in a unified manner a drum unit 82, which includes a photosensitive drum 2, a charging roller 3, and a cleaning unit 61, and a developing unit 83, which is swingably attached to the drum unit 82 and includes a developing roller 71. Thus, the user can attach and detach the cartridge 80 as a single unit to and from the apparatus main body 1A.

The developing unit 83 is supported by the drum unit 82 to be rotatable about a rotating shaft 84 and configured to pivot about the rotating shaft 84 so that the photosensitive drum 2 and the developing roller 71 come into contact with and separate from each other. Other components are similar to those in the first exemplary embodiment, and therefore are not described here.

(Configuration of Guide Unit of Cartridge)

Figure 11:
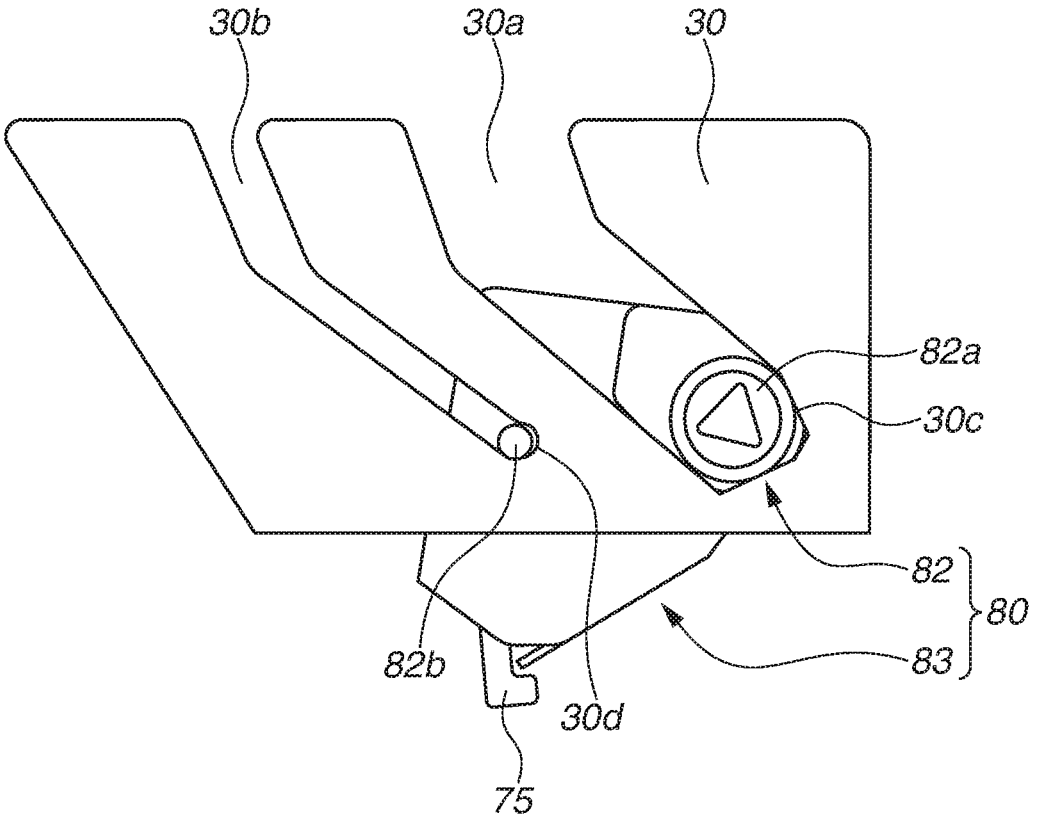
FIG. 11 is a side view of the cartridge and a cartridge guide.

Next, with reference to FIG. 11, a description is given of the configuration of a guide unit used when the cartridge 80 is attached to or detached from the apparatus main body 1A. FIG. 11 is a side view of the cartridge 80 and a cartridge guide 30 in the state where the cartridge 80 is attached to the apparatus main body 1A. Cartridge guides 30, which are guide units for guiding the cartridge 80, are included on the driving side and the non-driving side in the apparatus main body 1A and shaped symmetrically to each other. Although FIG. 11 illustrates the cartridge guide 30 on the driving side, the cartridge guides 30 are provided symmetrically on the driving side and the non-driving side with similar configurations. Thus, the details of the cartridge guide 30 on the non-driving side are not described here.

As described above, the cartridge 80 is a process cartridge that allows the drum unit 82 and the developing unit 83 to be attached to and detached from the apparatus main body 1A in a unified manner. As illustrated in FIG. 11, in the apparatus main body 1A, a cartridge guide 30 is provided, which is a guide unit used when the cartridge 80 is attached to the inside of the apparatus main body 1A. This cartridge guide 30 is included on each of the driving side and the non-driving side in the apparatus main body 1A. The cartridge guide 30 is fixed in the apparatus main body 1A and serves as a guide portion when the cartridge 80 is attached to the inside of the apparatus main body 1A. The cartridge guide 30 includes as guide portions a guide groove 30*a*, into which a drive input portion 82*a* of the drum unit 82 is inserted, and a guide groove 30*b*, into which a boss 82*b* of the drum unit 82 is inserted. The cartridge guide 30 includes a positioning portion 30*c*, which determines the position of the drive input portion 82*a* by the drive input portion 82*a* hitting the positioning portion 30*c*, and a positioning portion 30*d*, which determines the position of the boss 82*b* by the boss 82*b* hitting the positioning portion 30*d*. The drive input portion 82*a* and the boss 82*b* hit the positioning portions 30*c* and 30*d*, respectively, whereby the position of the drum unit 82 of the cartridge 80 in the apparatus main body 1A is determined. A pressing target portion 75 is pressed by a moving member 23, whereby the developing unit 83 pivots about the rotating shaft 84 relative to the drum unit 82 and can move to a separate position and a development position.

(Operation when Cartridge is Attached or Detached)

Figure 12:
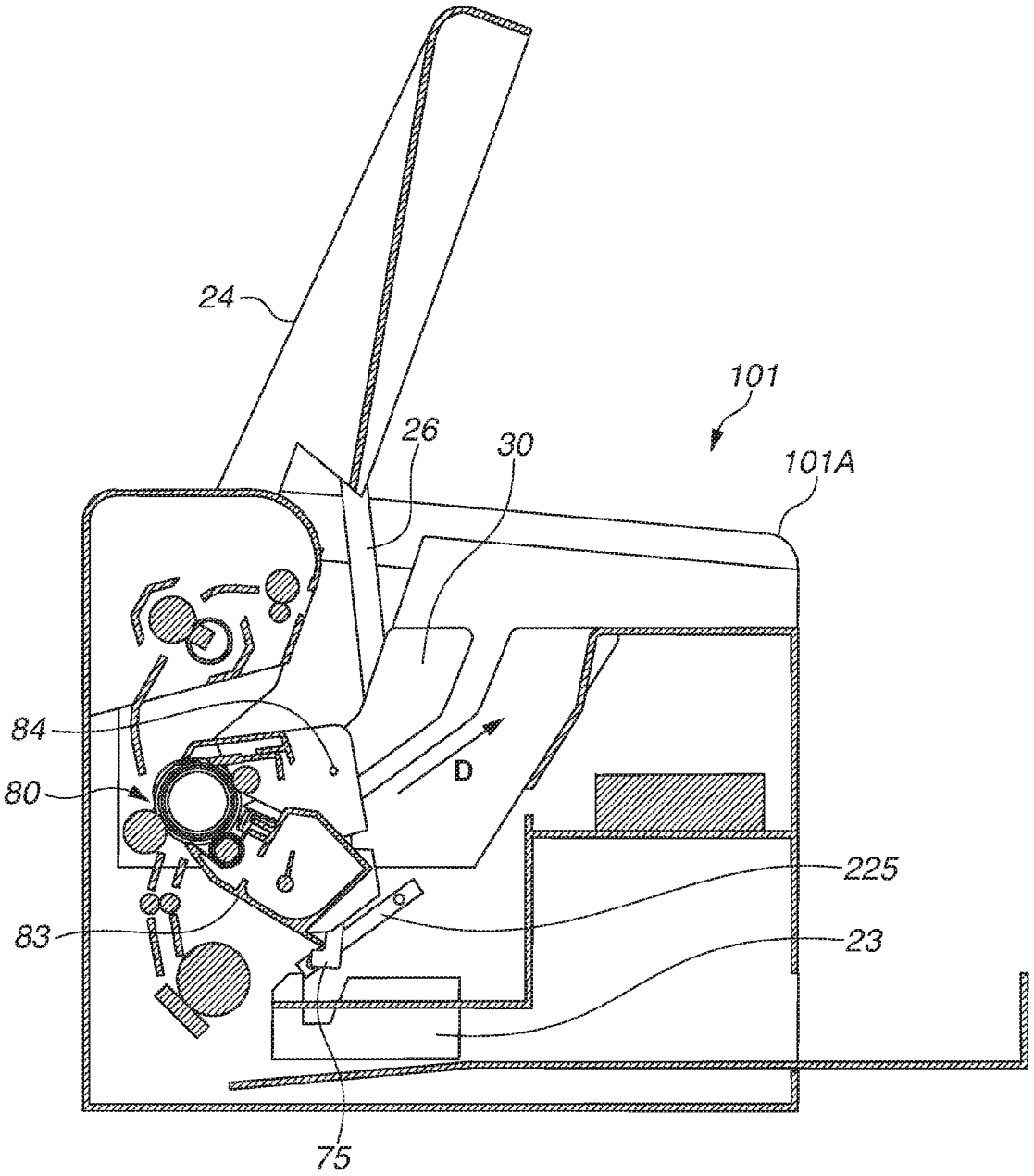
FIG. 12 is a cross-sectional view of an image forming apparatus in a state where an opening/closing member is opened.
Figure 13:
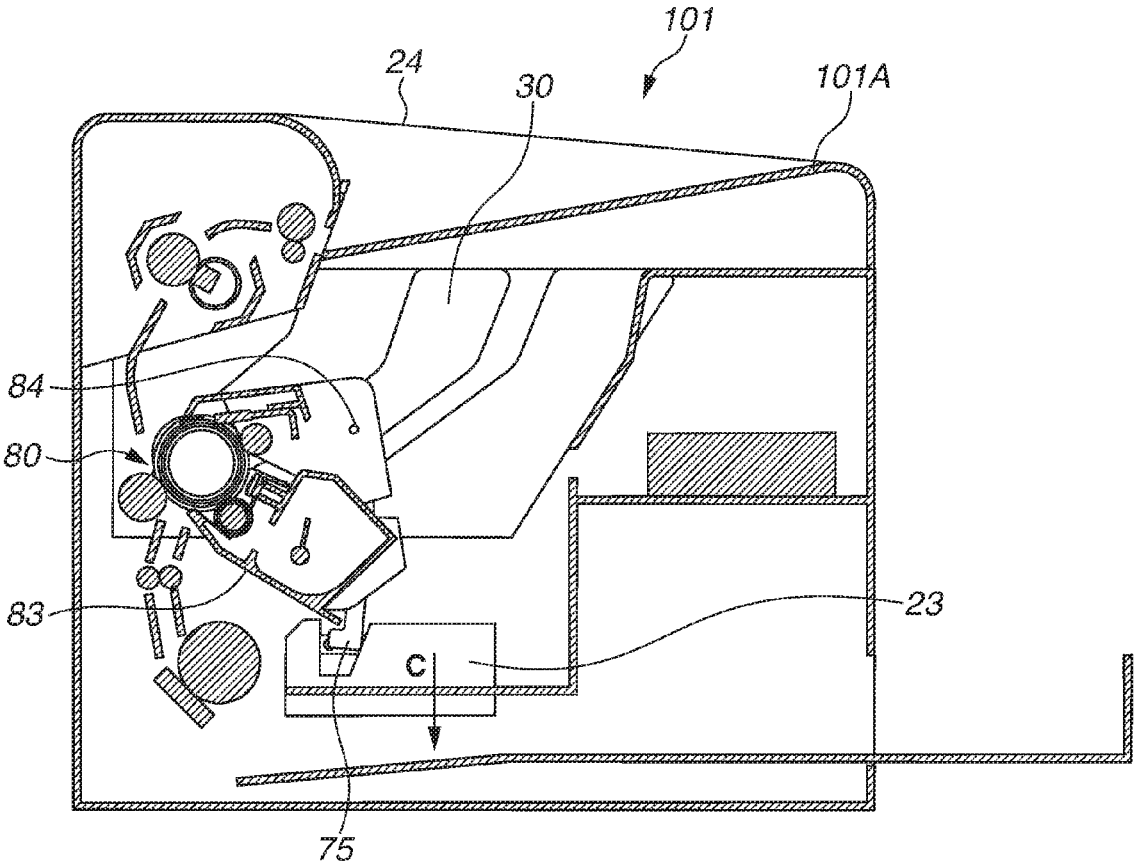
FIG. 13 is a cross-sectional view of the image forming apparatus in a state where the opening/closing member is closed.
Figure 14A:
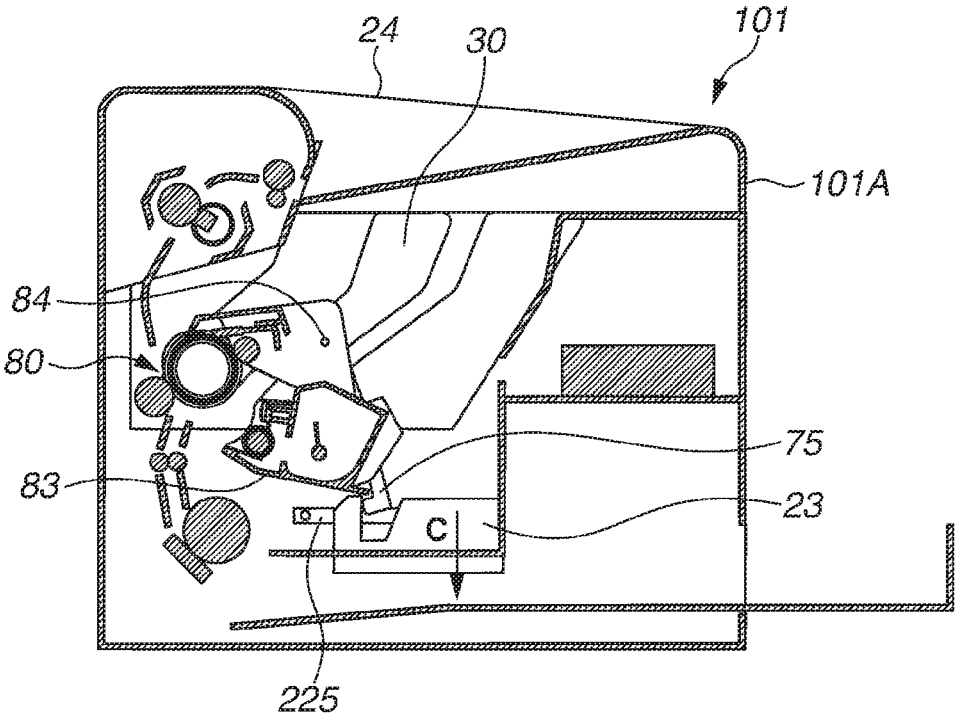
FIG. 14A is a cross-sectional view of the image forming apparatus in a state where the opening/closing member is closed.
Figure 14B:
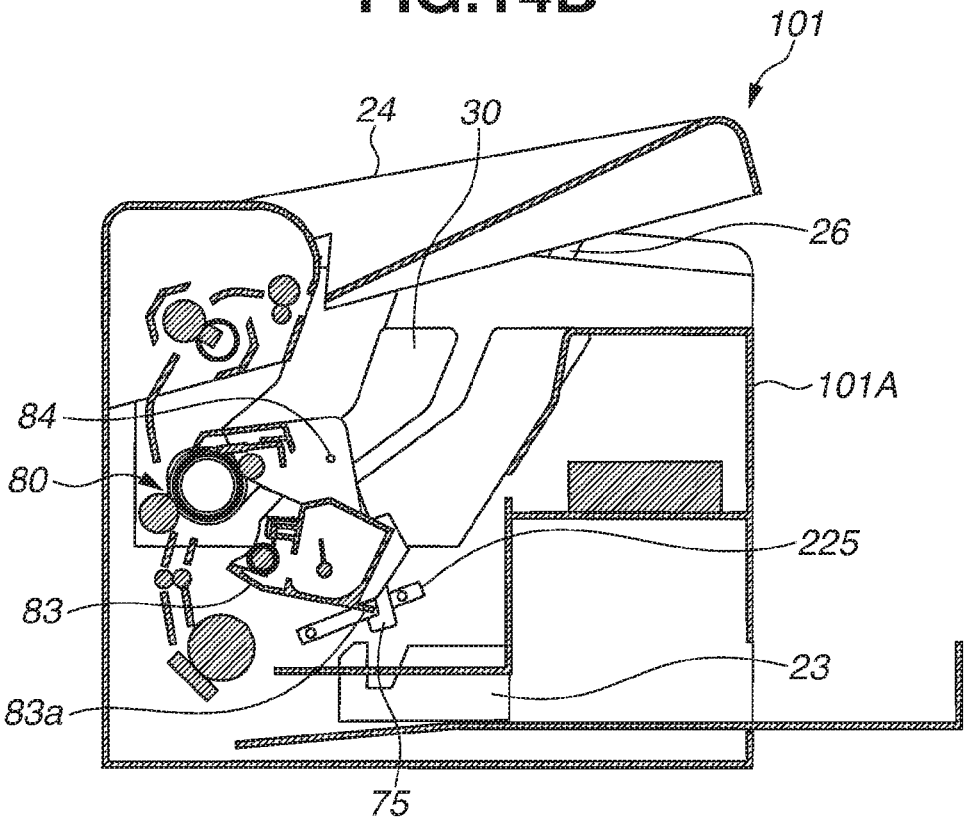
FIG. 14B is a cross-sectional view of the image forming apparatus, illustrating the middle of opening the opening/closing member.

Next, a description is given of the operation when the cartridge 80 is attached or detached. With reference to FIGS. 12, 13, 14A, and 14B, a description is given of the operation when the cartridge 80 is attached or detached in a case where the cartridge 80 stops in a contact state and in a case where the cartridge 80 stops in a separate state. FIG. 12 is a cross-sectional view of an image forming apparatus 101 in the state where an opening/closing member 24 is opened. FIG. 13 is a cross-sectional view of the image forming apparatus 101 when the cartridge 80 is in the contact state. FIGS. 14A and 14B are cross-sectional views of the image forming apparatus 101 when the cartridge 80 is in the separate state.

An apparatus main body 101A includes an opening/closing member 24, which opens and closes an opening through which the cartridge 80 passes when the cartridge 80 is attached to or detached from the cartridge guide 30. FIG. 12 illustrates the state where the opening/closing member 24 is opened, and the cartridge 80 can be attached and detached. Further, the apparatus main body 101A includes a restriction member 225, which pivots in conjunction with the opening and closing operation of the opening/closing member 24. As illustrated in FIG. 12, if the opening/closing member 24 opens, the restriction member 225 pivots through a first link member 26 in the direction in which the restriction member 225 comes close to the cartridge 80. Consequently, the restriction member 225 restricts the movement of the developing unit 83 of the cartridge 80 relative to the drum unit 82. Further, if the opening/closing member 24 closes, the restriction member 225 pivots through the first link member 26 in a direction away from the cartridge 80 and lifts the restriction of the movement of the developing unit 83 relative to the drum unit 82.

If the operation of opening the opening/closing member 24 is started in the state illustrated in FIG. 13, the moving member 23 moves in the direction of an arrow C, similarly to the first exemplary embodiment. Then, the biasing of the developing unit 83 is released, and the developing unit 83 becomes able to pivot about the rotating shaft 84. Then, as illustrated in FIG. 12, if the opening/closing member 24 opens to some extent, the restriction member 225 restricts the movement of the developing unit 83 of the cartridge 80. By the above operation, the cartridge 80 moves from the contact state to an attachable/detachable state, and the movement of the developing unit 83 is restricted by the restriction member 225. That is, the developing unit 83 moves to a detachment position, and the movement of the developing unit 83 in directions different from a detachment direction D is restricted. The detachment direction D is the direction in which the guide grooves 30*a* and 30*b* extend. In this state, the restriction member 225 functions also as an attachment/detachment guide for guiding the cartridge 80 in the detachment direction D.

If the opening/closing member 24 is opened in the state illustrated in FIG. 14A, the moving member 23 moves in the direction of an arrow C, similarly to the first exemplary embodiment. Then, the biasing of the developing unit 83 is released, and the developing unit 83 becomes able to pivot about the rotating shaft 84. As illustrated in FIG. 14B, if the opening/closing member 24 starts opening, the restriction member 225 pivots through the first link member 26 in the direction in which the restriction member 225 comes close to the cartridge 80, and the restriction member 225 comes into contact with a moving pressing surface 83*a* of the developing unit 83. Consequently, the developing unit 83 of the cartridge 80 moves to the position where the cartridge 80 is in an attachable/detachable state illustrated in FIG. 12. Then, the restriction member 225 restricts the movement of the developing unit 83 of the cartridge 80. By the above operation, after the cartridge 80 moves from the separate state to the attachable/detachable state, the movement of the developing unit 83 is restricted by the restriction member 225. That is, the developing unit 83 moves to a detachment position, and the movement of the developing unit 83 in directions different from a detachment direction D is restricted. In this state, the restriction member 225 functions also as an attachment/detachment guide for guiding the cartridge 80 in the detachment direction D.

(Variation 2)

In the second exemplary embodiment, the configuration is such that a cartridge moves from a contact state or a separate state to a single attachable/detachable state, and the movement of a developing unit is restricted by a restriction member. However, the present exemplary embodiment is also effective in a configuration in which the attachable/detachable state is not limited to a single attachable/detachable state, and a plurality of attachable/detachable states are included. With this configuration, it is also possible to obtain similar effects.

Summary of the Second Exemplary Embodiment

According to the second exemplary embodiment, after a cartridge moves from a contact state or a separate state to an attachable/detachable state by the operation of opening an opening/closing member, the movement of a developing unit becomes able to be restricted by a restriction member. That is, it is possible to provide an image forming apparatus in which a developing unit stops pivoting, thereby improving the operability of attachment and detachment of a process cartridge.

In a third exemplary embodiment, a description is given of a configuration for, when a developing unit is detached from an apparatus main body, reducing the load for moving the developing unit. First, with reference to FIG. 16, the overall configuration of the present exemplary embodiment is described. An image forming apparatus 1 illustrated in FIG. 16 forms an image on a recording medium P (e.g., a recording sheet, an OHP sheet, or cloth) using a developer by an electrophotographic image forming process according to image information from an external device, such as a personal computer, connected to the image forming apparatus 1 so that the external device can communicate with the image forming apparatus 1.

Figure 16:
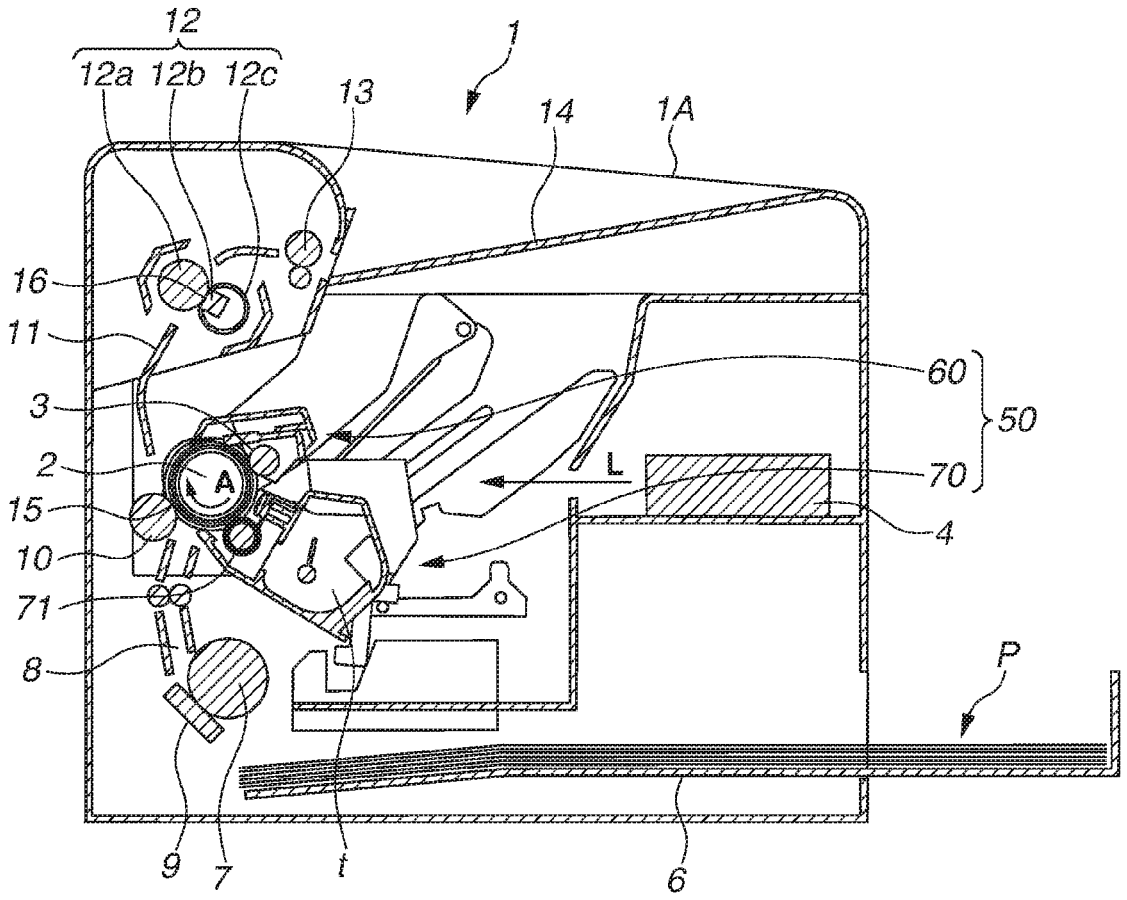
FIG. 16 is a cross-sectional view of an image forming apparatus and a cartridge.

FIG. 16 illustrates the state where a cartridge 50, which includes a drum cartridge 60 and a developing cartridge 70, is attached to an apparatus main body 1A. In the state where the cartridge 50 is attached, a rotating shaft of a photosensitive drum 2 is parallel to a rotating shaft of a developing roller 71. In the apparatus main body 1A and the cartridge 50, in the directions of the rotational axes of the photosensitive drum (photosensitive member) 2 and the developing roller 71, one end side where a coupling (a drive input portion 2*a*) for transmitting a driving force from the apparatus main body 1A to the photosensitive drum 2 and the developing roller 71 is placed is a driving side, and the other end side is a non-driving side. The longitudinal direction of the drum cartridge 60 is parallel to the rotating shaft of the photosensitive drum 2. The longitudinal direction of the developing cartridge 70 is parallel to the rotating shaft of the developing roller 71.

(Configuration of Image Forming Apparatus)

With reference to FIG. 16, the structure of the image forming apparatus 1 is described. The photosensitive drum 2 rotates in the direction of an arrow A, whereby the surface of the photosensitive drum 2 is uniformly charged by a charging roller 3 as a charging unit. An optical unit (exposure unit) 4 irradiates the photosensitive drum 2 with laser light L according to image information, thereby forming an electrostatic latent image according to the image information on the photosensitive drum 2. The electrostatic latent image formed on the photosensitive drum 2 is developed by the developing roller 71 serving as a developing unit and using toner t, thereby forming a toner image.

Meanwhile, in synchronization with the formation of the toner image, recording media P, which are set in a feeding cassette 6, are separated and fed one by one by a pickup roller 7 and a pressure contact member 9, which comes into pressure contact with the pickup roller 7. Then, each recording medium P is conveyed along a conveyance guide 8 to a transfer roller 10 serving as a transfer unit. Next, the recording medium P passes through a transfer nip portion 15, which is formed by the photosensitive drum 2 and the transfer roller 10 to which a certain voltage is applied. At this time, the toner image formed on the photosensitive drum 2 is transferred onto the recording medium P. The recording medium P onto which the toner image has been transferred is conveyed to a fixing unit 12 by a conveyance guide 11. The fixing unit 12 includes a driving roller 12*a* and a fixing roller 12*c*, into which a heater 12*b* is built. Heat and pressure are applied to the recording medium P passing through a nip portion 16, which is formed by the fixing roller 12*c* and the driving roller 12*a*, thereby fixing the transferred toner image to the recording medium P. Then, the recording medium P is conveyed by a discharge roller pair 13 and discharged to a discharge tray 14.

(Configuration of Cartridge)

Figure 17:
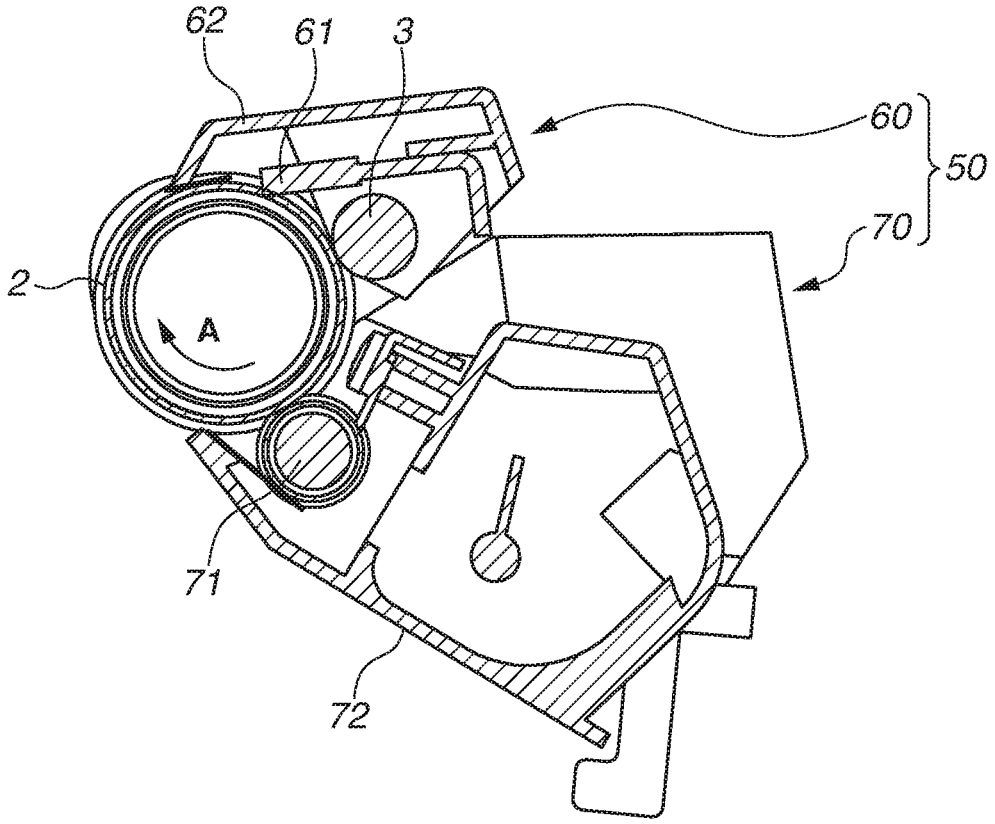
FIG. 17 is a cross-sectional view of the cartridge.
Figure 18:
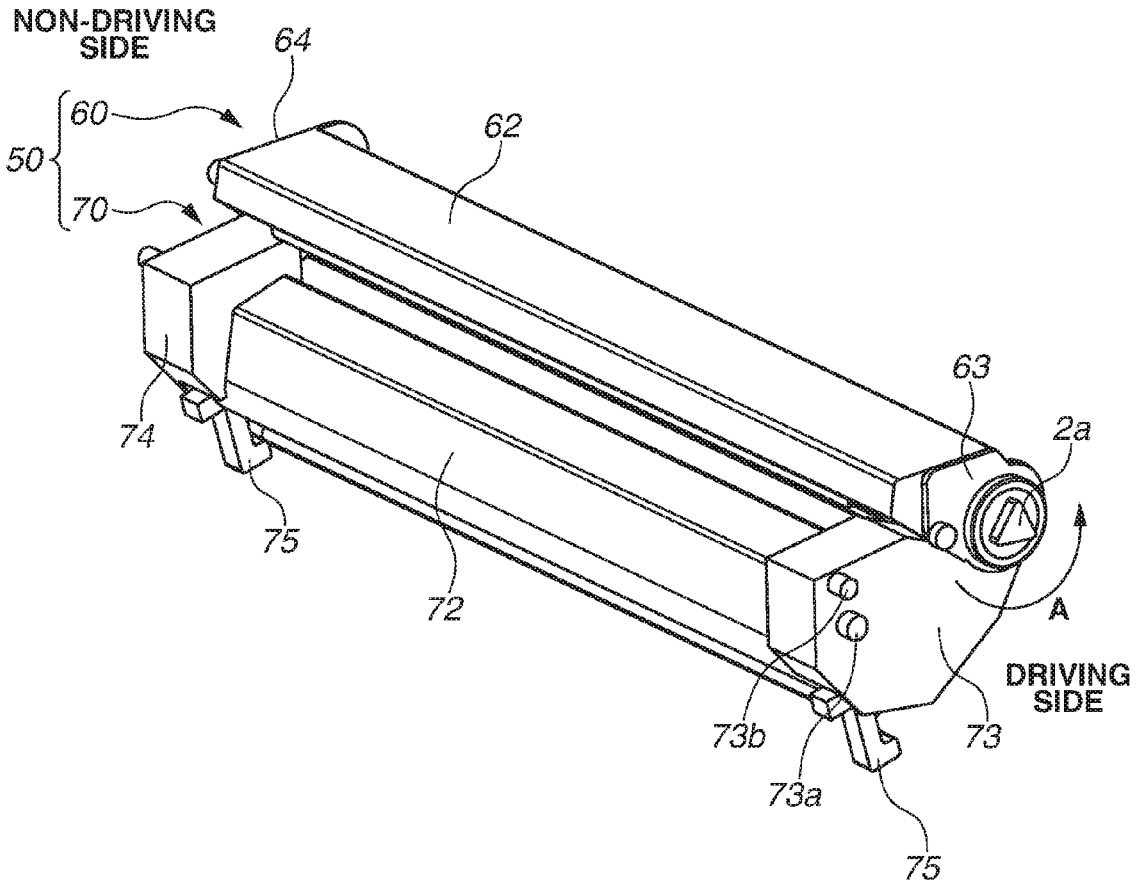
FIG. 18 is a perspective view of the cartridge.

Next, with reference to FIGS. 17 and 18, a description is given of the cartridge 50, which is attachable to and detachable from the apparatus main body 1A of the image forming apparatus 1 according to the present exemplary embodiment. FIG. 17 is a schematic cross-sectional view illustrating the configuration of the cartridge 50. As illustrated in FIG. 17, the cartridge 50 includes a drum cartridge 60, which includes a photosensitive drum 2, a charging roller 3, and a cleaning blade 61, and a developing cartridge 70, which includes a developing roller 71. A user can individually attach and detach each of the drum cartridge 60 and the developing cartridge 70 to and from the apparatus main body 1A. The drum cartridge 60 can be attached to and detached from the apparatus main body 1A by moving in a direction intersecting (a direction orthogonal to, in the present exemplary embodiment) the longitudinal direction of the drum cartridge 60. The developing cartridge 70 can be attached to and detached from the apparatus main body 1A by moving in a direction intersecting (a direction orthogonal to, in the present exemplary embodiment) the longitudinal direction of the developing cartridge 70.

FIG. 18 illustrates a perspective view of the cartridge 50, which includes the drum cartridge 60 and the developing cartridge 70. A cleaning frame member 62 of the drum cartridge 60 is rotatably supported by the photosensitive drum 2 through a driving-side drum bearing 63 and a non-driving-side drum bearing 64. A drive input portion 2*a*, which is provided in an end portion on the driving side in the longitudinal direction of the photosensitive drum 2, is configured to be engaged with a drive output portion (not illustrated) of the apparatus main body 1A and receive the driving force of a driving motor (not illustrated) of the apparatus main body 1A. Consequently, the photosensitive drum 2 is driven to rotate in the direction of an arrow A according to an image forming operation (see FIG. 17). The drive input portion 2*a* is a coupling in the shape of a slightly twisted triangular prism and is engaged with a drive transmission portion (a main-body-side coupling) (not illustrated) provided in the apparatus main body 1A. However, the shapes of the drive input portion 2*a* and the drive transmission portion of the apparatus main body 1A are not limited to these. A development frame member 72 of the developing cartridge 70 includes a driving-side development bearing 73 and a non-driving-side development bearing 74, which rotatably support the developing roller 71. Further, the developing cartridge 70 includes pressing target portions 75.

(Configuration of Guide Unit of Cartridge)

Figure 19:
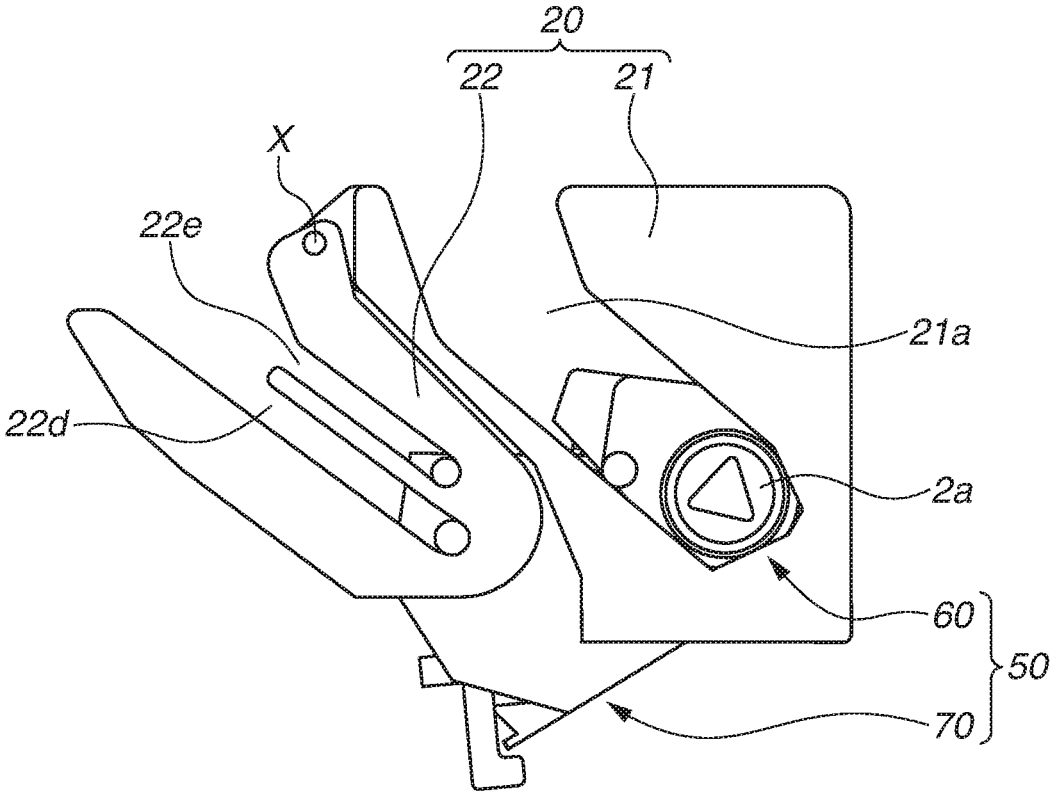
FIG. 19 is a side view of the cartridge and a cartridge guide.

Next, with reference to FIG. 19, a description is given of the configuration of a guide unit used when the cartridge 50 is attached to or detached from the apparatus main body 1A. FIG. 19 is a side view of the cartridge 50 and a cartridge guide 20 in the state where the cartridge 50 is attached to the apparatus main body 1A. Cartridge guides 20, which are guide units for guiding the cartridge 50, are included on the driving side and the non-driving side in the apparatus main body 1A and have shapes opposite to each other. Although FIG. 19 illustrates the cartridge guide 20 on the driving side, the guide 20 shaped symmetrically to the guide 20 on the driving side is also provided on the non-driving side. The configuration of the guide 20 on the non-driving side is similar to that of the guide 20 on the driving side, and therefore is not described here.

As described above, the cartridge 50 is divided into the drum cartridge 60 and the developing cartridge 70. As illustrated in FIG. 19, in the apparatus main body 1A, a cartridge guide 20 is provided, which is a guide unit used when the cartridge 50 is attached to the inside of the apparatus main body 1A. This cartridge guide 20 is included on each of the driving side and the non-driving side in the apparatus main body 1A. Further, the cartridge guide 20 includes a fixed guide 21 and a movable guide 22. The fixed guide 21 is fixed in the apparatus main body 1A and includes a guide groove 21*a*, into which the drive input portion 2*a* is inserted, as a guide unit for guiding the movement of the drum cartridge 60 when the drum cartridge 60 is attached to the inside of the apparatus main body 1A. The movable guide 22 is supported by the fixed guide 21 so as to be rotatable about a pivotal axis X, which serves as a movable guide rotating shaft and a fixed guide rotating shaft. The movable guide 22 includes a guide groove 22*d*, into which a boss 73*a* is inserted, and a guide groove 22*e*, into which a boss 73*b* is inserted, as guide portions for guiding the movement of the developing cartridge 70 when the developing cartridge 70 is attached to the inside of the apparatus main body 1A. The movable guide 22 is a supporting member for supporting the developing cartridge 70 and can move (rotate about the pivotal axis X) in a unified manner with the cartridge 70 in the state where the movable guide 22 supports the developing cartridge 70.

(Operation of Contact and Separation of Cartridge)

Figure 20A:
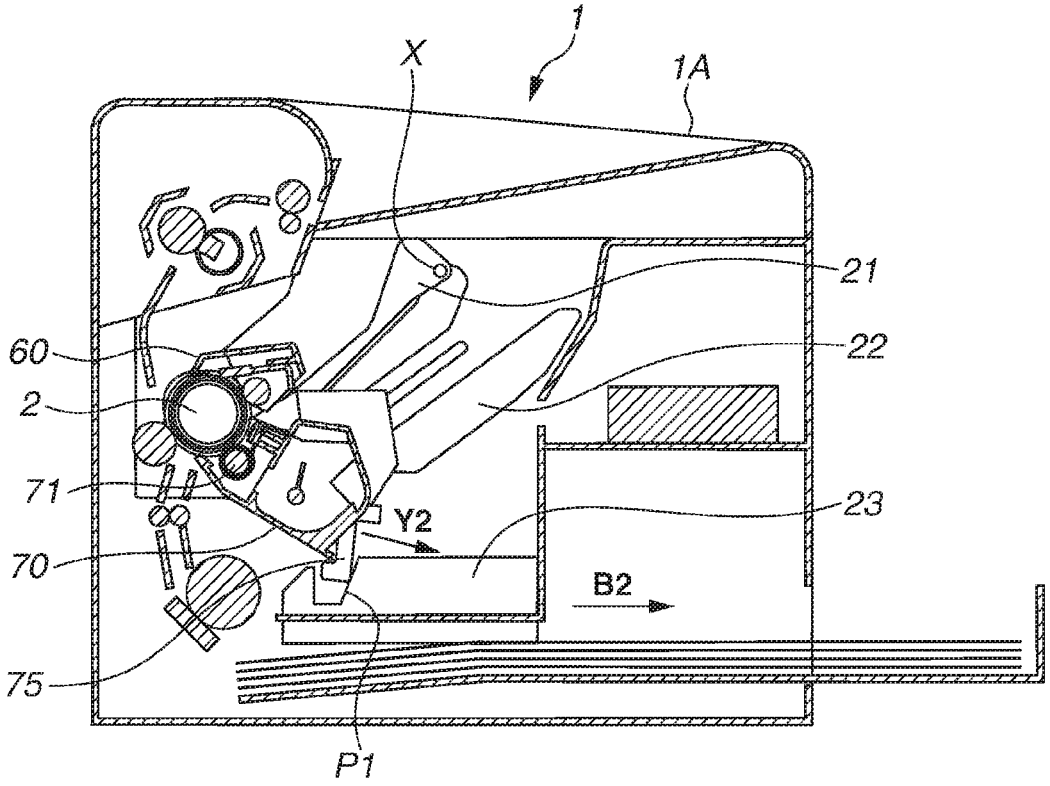
FIG. 20A is a cross-sectional view of the image forming apparatus, illustrating a contact state of the cartridge.
Figure 20B:
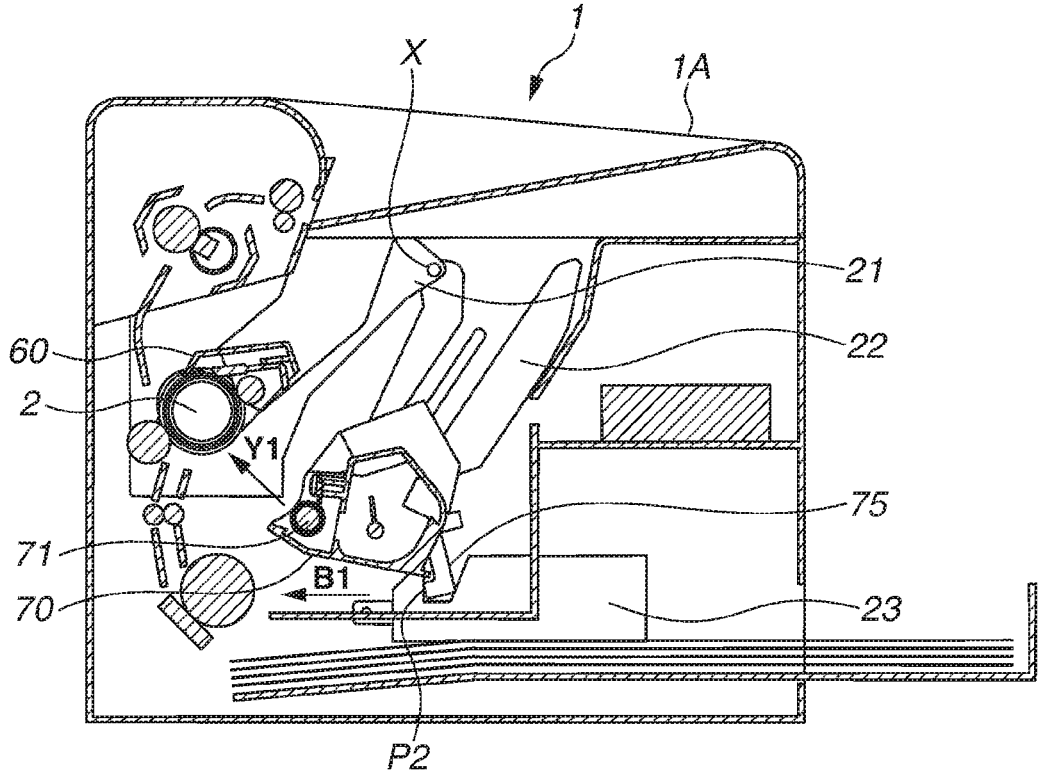
FIG. 20B is a cross-sectional view of the image forming apparatus, illustrating a separate state of the cartridge.

Next, a description is given of the contact and separation of the photosensitive drum 2 and the developing roller 71 of the cartridge 50. In the image forming apparatus 1, only when an image is transferred onto the recording medium P, the photosensitive drum 2 and the developing roller 71 are in contact with each other. In other cases, the photosensitive drum 2 and the developing roller 71 are separate from each other. FIGS. 20A and 20B illustrate this contact and separation. FIGS. 20A and 20B illustrate the state where the drum cartridge 60 is attached to the fixed guide 21, and the developing cartridge 70 is attached to the movable guide 22. FIG. 20A is a cross-sectional view illustrating a contact state of the cartridge 50. In the state illustrated in FIG. 20A, a moving member 23 is at a first pressing position and presses the pressing target portion 75 of the developing cartridge 70 on a first pressing surface P1. At this time, the movable guide 22 is at a first position, the developing cartridge 70 is at a development position, the photosensitive drum 2 and the developing roller 71 are in contact with each other, and the toner t borne on the surface of the developing roller 71 can be attached to the surface of the photosensitive drum 2.

FIG. 20B is a cross-sectional view illustrating a separate state of the cartridge 50. In the state illustrated in FIG. 20B, the moving member 23 is at a second pressing position and presses the pressing target portion 75 of the developing cartridge 70 on a second pressing surface P2. At this time, the movable guide 22 is at a second position different from the first position, and the photosensitive drum 2 and the developing roller 71 are separate from each other. That is, at this time, the developing cartridge 70 is at a separate position, and the toner t borne on the surface of the developing roller 71 cannot be attached to the surface of the photosensitive drum 2. As described above, when the developing cartridge 70 is at the separate position, the developing roller 71 is at a position further away from the photosensitive drum 2 than when the developing cartridge 70 is at the development position.

If a job signal is input to the apparatus main body 1A, a driving source (not illustrated) of the apparatus main body 1A moves the moving member 23 in the direction of an arrow B1. Then, the moving member 23 biases the pressing target portion 75 supported by the developing cartridge 70, and this biasing force is transmitted to the developing cartridge 70 through a pressure spring (not illustrated). As a result, the developing cartridge 70 receiving the biasing force pivots in a unified manner with the movable guide 22 about a rotation center X of the movable guide 22 in the direction of an arrow Y1. Then, as illustrated in FIG. 20A, the developing roller 71 and the photosensitive drum 2 come into contact with each other. Then, a toner image becomes able to be formed on the photosensitive drum 2. After the operation of forming the toner image on the photosensitive drum 2 ends, the moving member 23 moves in the direction of an arrow B2 and biases the pressing target portion 75 to move the developing cartridge 70 so that the developing roller 71 separates from the photosensitive drum 2. Consequently, the developing cartridge 70 and the movable guide 22 pivot about the rotation center X in the direction of an arrow Y2. Then, as illustrated in FIG. 20B, the developing roller 71 is further away from the photosensitive drum 2 than in the state illustrated in FIG. 20A.

(Operation when Opening/Closing Member 24 is Opened)

Next, a description is given of the operation when the cartridge 50 is attached or detached. In the image forming apparatus 1, in a case where the recording medium P is jammed in the apparatus main body 1A, or in a case where the toner t in the cartridge 50 is used up, the user needs to open an opening/closing member 24 at a closed position to an opened position and perform the operation of taking out the cartridge 50 and the operation of attaching the cartridge 50. When the user opens the opening/closing member 24, then in the apparatus main body 1A, there is a case where the cartridge 50 stops in the contact state, or a case where the cartridge 50 stops in the separate state. In the present exemplary embodiment, the configuration is such that when the opening/closing member 24 is opened, the moving member 23 retracts in conjunction with the opening and closing operation of the opening/closing member 24 in either of a case where the cartridge 50 is in the contact state and a case where the cartridge 50 is the separate state.

(Case where Opening/Closing Member 24 is Opened when Cartridge 50 is in Contact State)

Figure 21A:
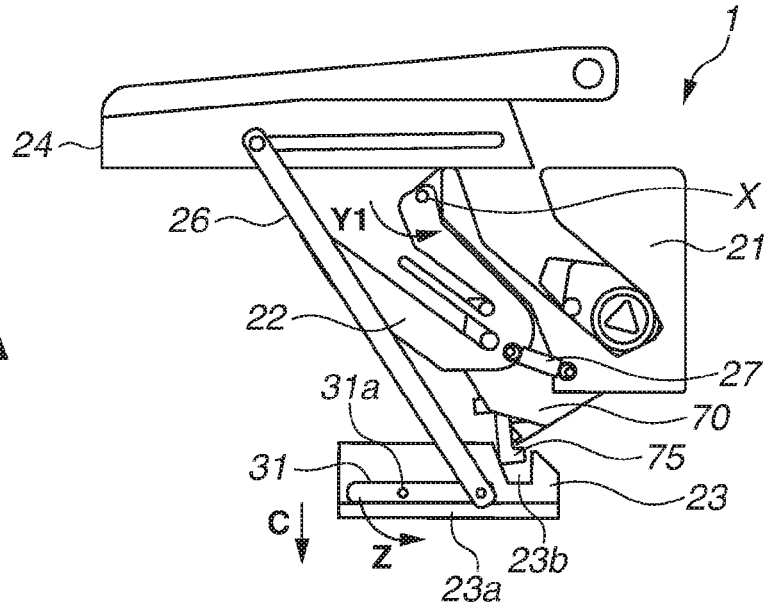
FIG. 21A is a side view of the opening/closing member, the cartridge, the cartridge guide, and a contact/separation slide.
Figure 21B:
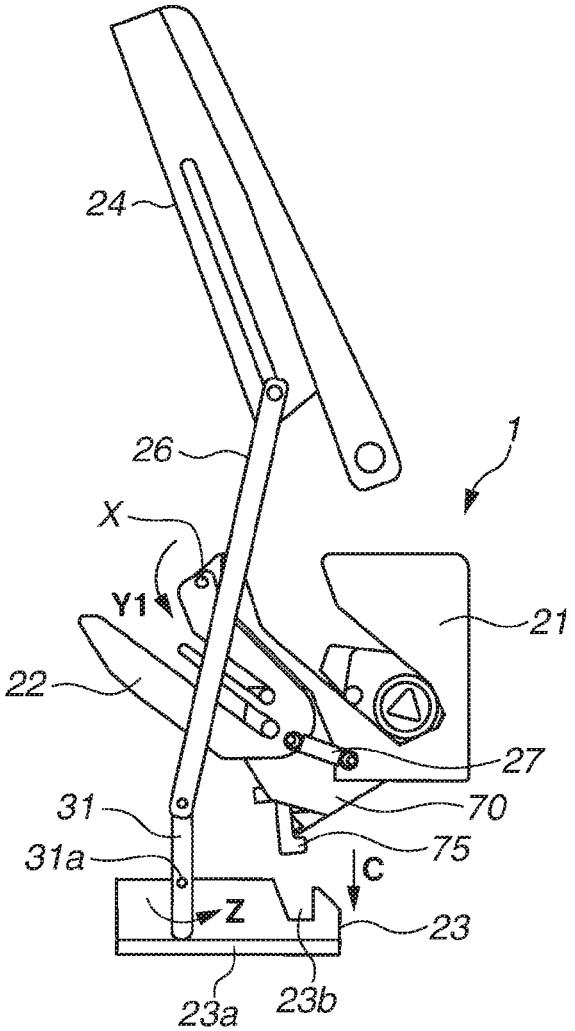
FIG. 21B is a side view of the opening/closing member, the cartridge, the cartridge guide, and the contact/separation slide.

First, a case is described where the opening/closing member 24 is opened when the cartridge 50 is in the contact state. If the formation of an image on a recording material ends, the operation of the apparatus main body 1A stops with the cartridge 50 in the separate state. However, in a case where the recording medium P is jammed in the apparatus main body 1A, the operation of the apparatus main body 1A stops with the cartridge 50 in the contact state. In this case, the opening/closing member 24 is opened when the cartridge 50 is in the contact state. FIGS. 21A and 21B are cross-sectional views of the image forming apparatus 1 when the cartridge 50 is in the contact state, as viewed from the driving side to the non-driving side. FIG. 21A illustrates the state where the opening/closing member 24 is closed. FIG. 21B illustrates the state where the opening/closing member 24 is opened. The apparatus main body 1A includes a second link member 31, which pivots about a rotation center 31*a* in conjunction with the opening and closing operation of the opening/closing member 24.

As illustrated in FIG. 21A, before the opening/closing member 24 is opened, the moving member 23 is at the first pressing position, and the cartridge 50 is in the contact state. The pressing target portion 75 of the cartridge 50 is inserted into a recessed portion 23*b* of the moving member 23, whereby the moving member 23 and the pressing target portion 75 are engaged together.

If the user continues to open the opening/closing member 24, the second link member (release member) 31, which is linked to a first link member (linking member) 26, pivots in the direction of an arrow Z by the movement of the first link member 26 when the opening/closing member 24 opens, as illustrated in FIG. 21B. Consequently, the second link member 31 presses and pushes down a pressing target surface 23*a* of the moving member 23 in the direction of an arrow C and moves the moving member 23 to a first pressing release position. That is, the second link member 31 moves the moving member 23 to the first pressing release position in relation to the opening operation of the opening/closing member 24. Consequently, when the opening/closing member 24 is in a closed state, and even in a case where the pressing target portion 75 of the cartridge 50 is inserted into the recessed portion 23*b* of the moving member 23, the pressing target portion 75 comes out of the recessed portion 23*b*. Consequently, the engagement between the moving member 23 and the pressing target portion 75 is released.

A guide spring 27 is provided between the fixed guide 21 and the movable guide 22 of the cartridge guide 20 and biases the movable guide 22 to move in the direction of an arrow Y1 about a rotating shaft X. Thus, even if the engagement between the moving member 23 and the pressing target portion 75 is released, the position of the movable guide 22 is determined by the action of the guide spring 27 at a predetermined position where the developing roller 71 and the photosensitive drum 2 come into contact with each other. This predetermined position is an attachment/detachment position where the cartridge 50 can be attached to and detached from the movable guide 22.

(Case where Opening/Closing Member 24 is Opened when Cartridge 50 is in Separate State)

Figure 22A:
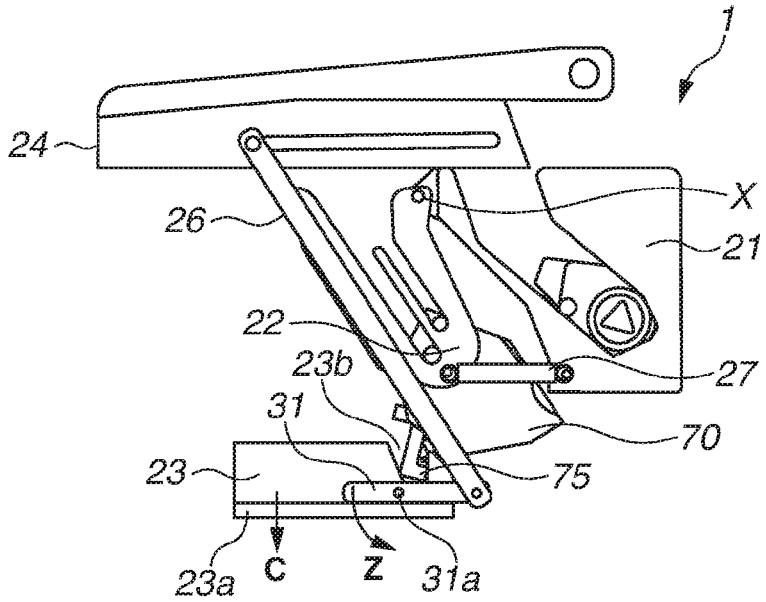
FIG. 22A is a side view of the opening/closing member, the cartridge, the cartridge guide, and the contact/separation slide.
Figure 22B:
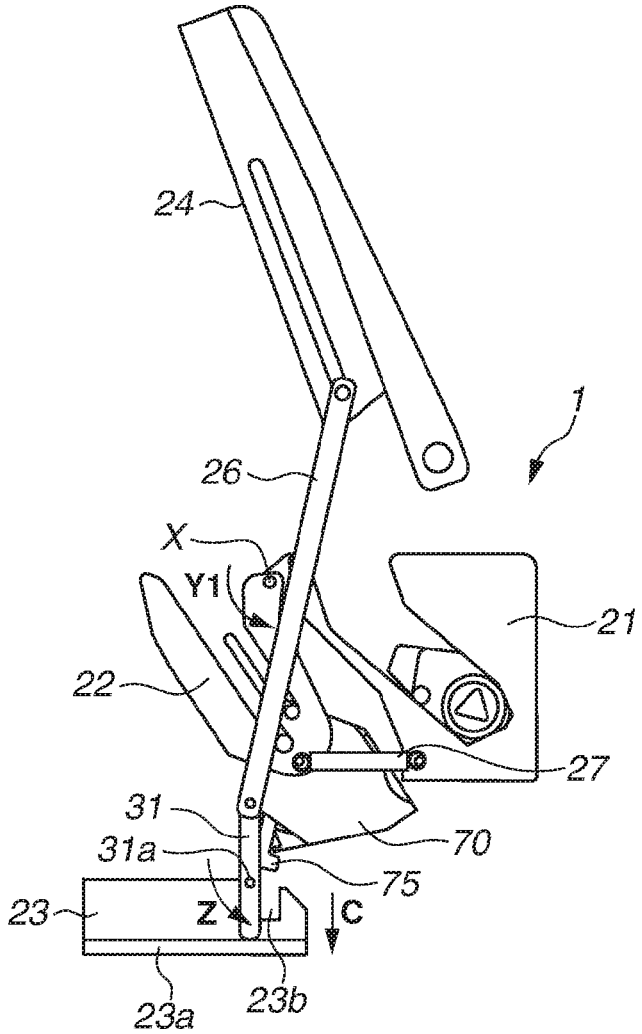
FIG. 22B is a side view of the opening/closing member, the cartridge, the cartridge guide, and the contact/separation slide.

First, a case is described where the opening/closing member 24 is opened when the cartridge 50 is in the separate state. If the formation of an image on a recording material ends, the operation of the apparatus main body 1A stops with the cartridge 50 in the separate state. In this case, the opening/closing member 24 is opened when the cartridge 50 is in the separate state. FIGS. 22A and 22B are cross-sectional views of the image forming apparatus 1 when the cartridge 50 is in the separate state, as viewed from the driving side to the non-driving side. FIG. 22A illustrates the state where the opening/closing member 24 is closed. FIG. 22B illustrates the state where the opening/closing member 24 is opened. The apparatus main body 1A includes a second link member 31, which pivots about a rotation center 31*a* in conjunction with the opening and closing operation of the opening/closing member 24.

As illustrated in FIG. 22A, before the opening/closing member 24 is opened, the moving member 23 is at the second pressing position, and the cartridge 50 is in the separate state. The pressing target portion 75 of the cartridge 50 is inserted into a recessed portion 23*b* of the moving member 23, whereby the moving member 23 and the pressing target portion 75 are engaged together.

If the user continues to open the opening/closing member 24, the second link member 31, which is linked to a first link member 26, pivots in the direction of an arrow Z by the movement of the first link member 26 when the opening/closing member 24 opens, as illustrated in FIG. 22B. Consequently, the second link member 31 pushes down a pressing target surface 23*a* of the moving member 23 in the direction of an arrow C and moves the moving member 23 to a second pressing release position. Consequently, when the opening/closing member 24 is in a closed state, and even in a case where the pressing target portion 75 of the cartridge 50 is inserted into the recessed portion 23*b* of the moving member 23, the pressing target portion 75 comes out of the recessed portion 23*b*. Consequently, the engagement between the moving member 23 and the pressing target portion 75 is released.

If the engagement between the moving member 23 and the pressing target portion 75 is released, the movable guide 22 moves by the action of the guide spring 27 to a predetermined position where the developing roller 71 and the photosensitive drum 2 come into contact with each other, and the position of the movable guide 22 is determined at the predetermined position. This predetermined position is an attachment/detachment position where the cartridge 50 can be attached to and detached from the movable guide 22.

As described above, if the opening/closing member 24 is opened, the engagement between the moving member 23 and the pressing target portion 75 is released, regardless of whether the cartridge 50 is in the contact state or the separate state. Thus, when the developing unit 70 is moved to detach the developing unit 70 from the apparatus main body 1A, it is possible to prevent the moving member 23 from being caught by the pressing target portion 75 and resisting the taking out of the developing unit 70. Consequently, it is possible to reduce the load for moving the developing unit 70 when detaching the developing unit 70 from the apparatus main body 1A.

The first and second pressing release positions are different positions, but are the same in the sense that the pressing and the engagement with the pressing target portion 75 are released at both the first and second pressing release positions. Thus, it can be said that both the first and second pressing release positions are a pressing release position.

Further, when the moving member 23 is at an intermediate position between the first and second pressing positions, and even if the opening/closing member 24 is opened, the moving member 23 moves to the pressing release position by the pivoting of the second link member 31 in the direction of the arrow Z in conjunction with the opening/closing member 24.

Further, FIGS. 21A, 21B, 22A, and 22B illustrate the movable guide 22, the first link member 26, the second link member 31, and the moving member 23 on the driving side. However, the configuration is such that also on the non-driving side, a similar movable guide 22, a similar first link member 26, a similar second link member 31, and a similar moving member 23 are provided, and similarly to the driving side, operated in conjunction with the opening and closing operation of the opening/closing member 24.

In the present exemplary embodiment, the configuration is such that in either of a case where the cartridge 50 is in the contact state and a case where the cartridge 50 is in the separate state, and if the engagement between the moving member 23 and the pressing target portion 75 is released, the movable guide 22 moves to the predetermined position (the attachment/detachment position) where the developing roller 71 and the photosensitive drum 2 come into contact with each other. Alternatively, the predetermined position may be set to a position where the developing roller 71 and the photosensitive drum 2 do not come into contact with each other. Yet alternatively, the configuration may be such that if the engagement is released in the contact state, the movable guide 22 moves to a first predetermined position, and if the engagement is released in the separate state, the movable guide 22 moves to a second predetermined position.

Further, in the present exemplary embodiment, the configuration is such that the moving member 23 moves downward, thereby moving from the first pressing position to the first pressing release position or moving from the second pressing position to the second pressing release position. However, the first and second pressing release positions are not limited to such positions. That is, the first pressing release position may be any position where the moving member 23 does not come into contact with the pressing target portion 75, and does not come into contact with the pressing target portion 75 also when the cartridge 50 is attached to or detached from the movable guide 22.

(Initial Operation after Opening/Closing Member 24 is Closed)

Figure 23A:
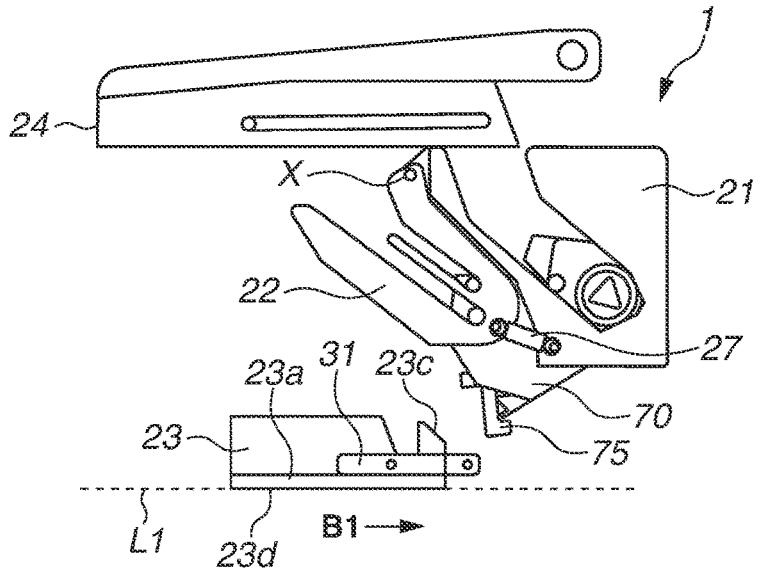
FIG. 23A is a side view of the opening/closing member, the cartridge, the cartridge guide, and the contact/separation slide.
Figure 23B:
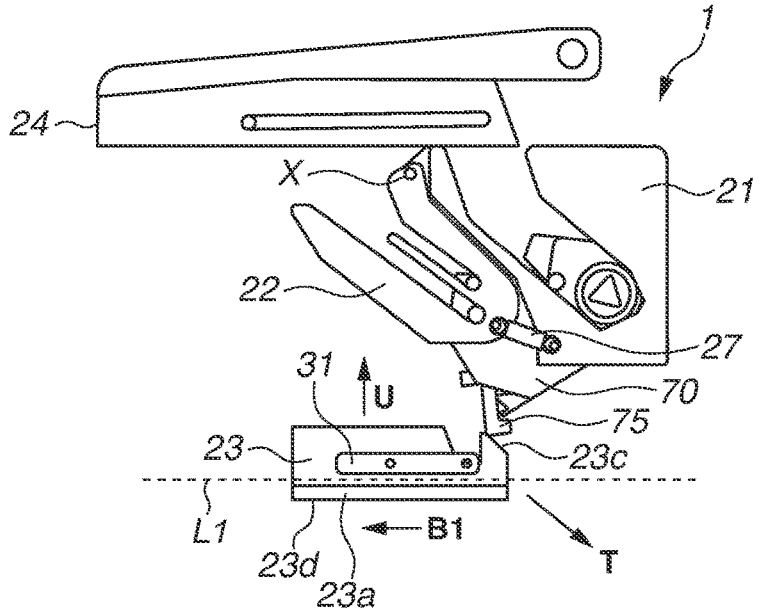
FIG. 23B is a side view of the opening/closing member, the cartridge, the cartridge guide, and the contact/separation slide.

Next, a description is given of an initial operation executed when the opening/closing member 24 is closed after the cartridge 50 is detached from the apparatus main body 1A and attached to the apparatus main body 1A again. FIGS. 23A and 23B are cross-sectional views of the image forming apparatus 1 when the cartridge 50 is in the separate state, as viewed from the driving side to the non-driving side. FIG. 23A illustrates the state where the moving member 23 is at the second pressing position. FIG. 23B illustrates the state where the moving member 23 is at a position between the first and second pressing positions. When the moving member 23 is at the second pressing position, the opening/closing member 24 is opened, and the moving member 23 is moved to the second pressing release position. Then, if the opening/closing member 24 is closed, the moving member 23 moves to the second pressing position as illustrated in FIG. 23A. The movable guide 22, however, is at the predetermined position where the developing roller 71 and the photosensitive drum 2 come into contact with each other. Thus, the positions of the pressing target portion 75 and the recessed portion 23*b* of the moving member 23 are shifted from each other, and the pressing target portion 75 is not inserted into the recessed portion 23*b*.

Thus, based on the fact that the opening/closing member 24 is closed, the apparatus main body 1A starts an initial operation and moves the moving member 23 from the second pressing position toward the first pressing position in the direction of an arrow B1. During this movement, as illustrated in FIG. 23B, a sloping surface 23*c* of the moving member 23 slides in contact with the pressing target portion 75, whereby the moving member 23 moves in the direction of an arrow T and is pushed down. The configuration is such that when a bottom portion 23*d* of the moving member 23 is below a reference line L1 (a line parallel to the direction of the arrow B1), the moving member 23 is biased in the direction of an arrow U by a spring (not illustrated). Thus, if the moving member 23 moves in the direction of the arrow T to the position where the recessed portion 23*b* is opposed to the pressing target portion 75, the moving member 23 moves in the direction of the arrow U by the biasing force of the spring, the pressing target portion 75 is inserted into the recessed portion 23*b*, and the moving member 23 and the pressing target portion 75 become engaged together. By the above operation, even if the moving member 23 and the pressing target portion 75 are not engaged together when the opening/closing member 24 is closed, it is possible to engage the moving member 23 and the pressing target portion 75 together.

(Variation)

In the above description, a description has been given of the image forming apparatus 1 to which the cartridge 50 including the drum cartridge 60 and the developing cartridge 70 is attached. However, the configuration of the moving member 23 is also applicable to an image forming apparatus 1 to which a cartridge 80 configured as a process cartridge by unifying a drum unit 82 and a developing unit 83 is attached.

(Configuration of Cartridge 80 According to Variation)

Figure 24:
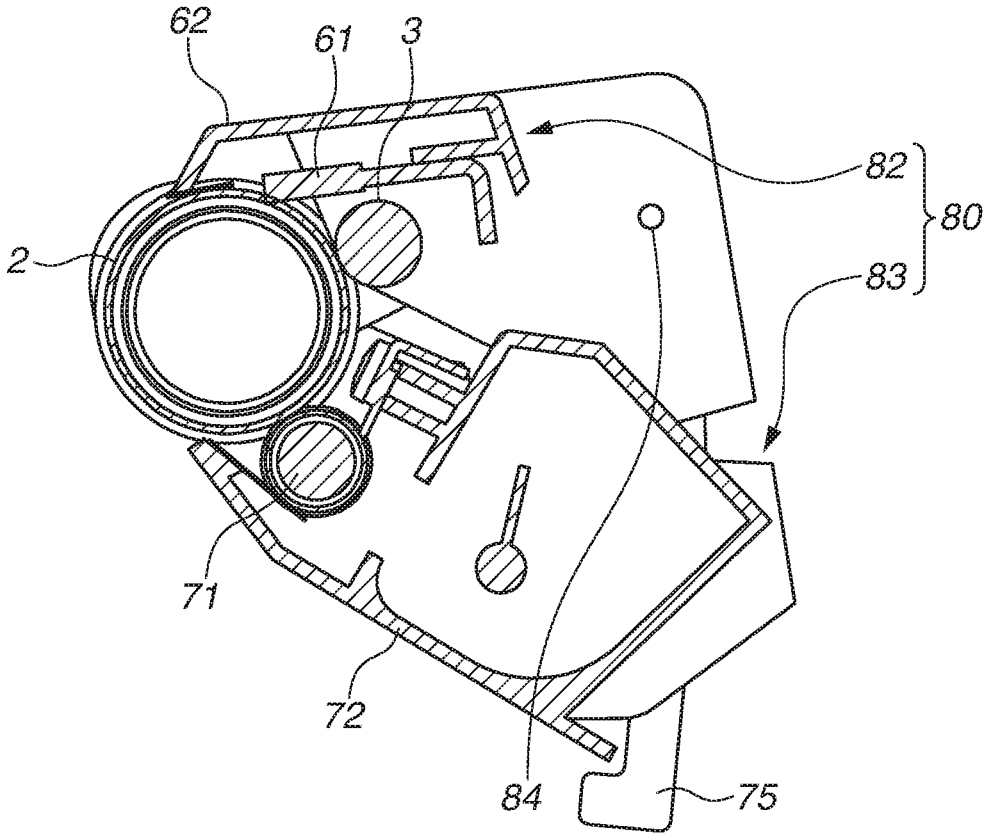
FIG. 24 is a cross-sectional view of a cartridge.

With reference to FIG. 24, the cartridge 80 according to a variation is described. FIG. 24 is a schematic cross-sectional view illustrating the configuration of the cartridge 80. The cartridge 80 includes in a unified manner a drum unit 82, which includes a photosensitive drum 2, a charging roller 3, and a cleaning unit 61, and a developing unit 83, which is swingably attached to the drum unit 82 and includes a developing roller 71. Thus, the user can attach and detach the cartridge 80 as a single unit to and from the apparatus main body 1A.

The developing unit 83 is supported by the drum unit 82 to be rotatable about a rotating shaft 84 and configured to pivot about the rotating shaft 84 so that the photosensitive drum 2 and the developing roller 71 come into contact with and separate from each other. Other components are similar to those in the first exemplary embodiment, and therefore are not described here.

(Configuration of Guide Unit According to Variation)

Figure 25:
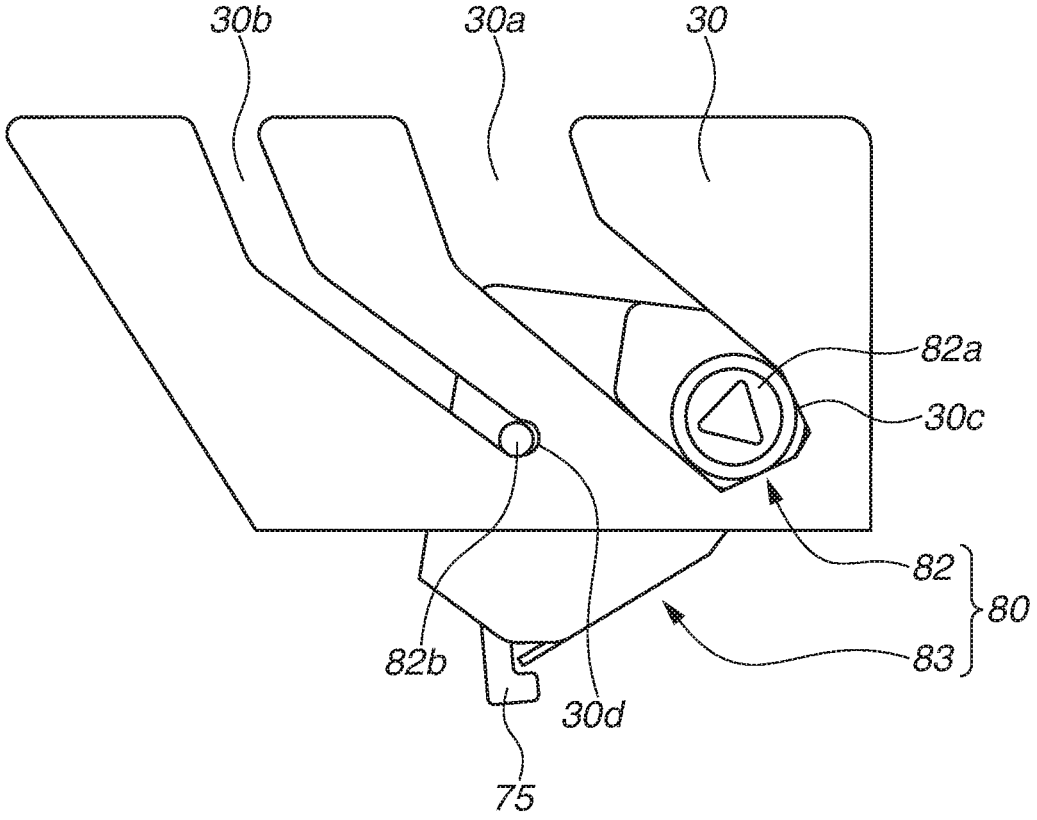
FIG. 25 is a side view of the cartridge and a cartridge guide.

Next, with reference to FIG. 25, a description is given of the configuration of a guide unit used when the cartridge 80 is attached to or detached from the apparatus main body 1A. FIG. 25 is a side view of the cartridge 80 and a cartridge guide 30 in the state where the cartridge 80 is attached to the apparatus main body 1A. Cartridge guides 30, which are guide units for guiding the cartridge 80, are included on the driving side and the non-driving side in the apparatus main body 1A and shaped symmetrically to each other. The cartridge guides 30 are provided instead of the guide units 20 in the above exemplary embodiment. Although FIG. 25 illustrates the cartridge guide 30 on the driving side, the cartridge guides 30 are provided symmetrically on the driving side and the non-driving side with similar configurations. Thus, the details of the cartridge guide 30 on the non-driving side are not described here.

As described above, the cartridge 80 is a process cartridge that allows the drum unit 82 and the developing unit 83 to be attached to and detached from the apparatus main body 1A in a unified manner. As illustrated in FIG. 25, in the apparatus main body 1A, a cartridge guide 30 is provided, which is a guide unit used when the cartridge 80 is attached to the inside of the apparatus main body 1A. This cartridge guide 30 is included on each of the driving side and the non-driving side in the apparatus main body 1A. The cartridge guide 30 is fixed in the apparatus main body 1A and serves as a guide portion when the cartridge 80 is attached to the inside of the apparatus main body 1A. The cartridge guide 30 includes as guide portions a guide groove 30*a*, into which a drive input portion 82*a* of the drum unit 82 is inserted, and a guide groove 30*b*, into which a boss 82*b* of the drum unit 82 is inserted. The cartridge guide 30 includes a positioning portion 30*c*, which determines the position of the drive input portion 82*a* by the drive input portion 82*a* hitting the positioning portion 30*c*, and a positioning portion 30*d*, which determines the position of the boss 82*b* by the boss 82*b* hitting the positioning portion 30*d*. The drive input portion 82*a* and the boss 82*b* hit the positioning portions 30*c* and 30*d*, respectively, whereby the position of the drum unit 82 of the cartridge 80 in the apparatus main body 1A is determined. A pressing target portion 75 is pressed by a moving member 23, whereby the developing unit 83 pivots about the rotating shaft 84 relative to the drum unit 82 and can move to a separate position and a development position.

Such an image forming apparatus 1 to which the cartridge 80 is attached may have a configuration in which as described above, if the opening/closing member 24 is opened, the engagement between the moving member 23 and the pressing target portion 75 is released, regardless of whether the cartridge 80 is in the contact state or the separate state.

Summary of the Third Exemplary Embodiment

According to the above exemplary embodiment, the moving member 23 moves to a pressing release position in conjunction with the opening operation of the opening/closing member 24, and the pressing of the developing cartridge 70 is released. Consequently, when the developing unit 70 is moved to detach or attach the developing cartridge 70, it is possible to prevent the moving member 23 from being caught by the pressing target portion 75 and resisting the taking out of the developing unit 70. Consequently, it is possible to reduce the load for moving the developing unit 70 when detaching or attaching the developing unit 70 from or to the apparatus main body 1A, and improve the operability and the stability when the developing unit 70 is attached or detached.

Further, in a case where the attachment/detachment position of the movable guide 22 is a single position, and if the opening/closing member 24 is opened, the movable guide 22 moves to the single position, regardless of which position the developing cartridge 70 is at. Thus, it is only necessary to provide a single attachment/detachment path for the developing cartridge 70. Thus, it is possible to attach and detach the developing cartridge 70 even if an opening or a space through which the developing cartridge 70 passes when the developing cartridge 70 is attached to or detached from the apparatus main body 1A is not formed to be large in the apparatus main body 1A. This leads to downsizing of the apparatus main body 1A.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-144643, filed Jul. 22, 2016, and No. 2016-144644, filed Jul. 22, 2016, which are hereby incorporated by reference herein in their entirety.

What is claimed is:

1. An image forming apparatus comprising:

a supporting member configured to support a developing unit including a developing roller and be movable between a first position where the developing roller can attach toner to a photosensitive member, and a second position where the developing roller is separate from the photosensitive member so that the developing roller does not attach toner to the photosensitive member;

an opening/closing member configured to open and close an opening through which the developing unit passes when the developing unit is attached to or detached from the supporting member; and a restriction member configured to restrict a movement of the supporting member from a third position different from the first and second positions, wherein in case where the opening/closing member is opened when the supporting member is at the first position, the restriction member presses the supporting member to move to the third position, and in case where the opening/closing member is opened when the supporting member is at the second position, the restriction member presses the supporting member to move to the third position.

2. The image forming apparatus according to claim 1, wherein the developing unit can be attached to or detached from the supporting member by moving the developing unit in a direction intersecting a longitudinal direction of the developing unit.

3. The image forming apparatus according to claim 1, wherein the supporting member includes an engagement target portion with which the restriction member is engaged when the supporting member is at the third position.

4. The image forming apparatus according to claim 3, wherein the supporting member includes a force reception portion for receiving a force from the restriction member, and in a case where the opening/closing member is opened, the supporting member receives in the force reception portion a pressing force from the restriction member and moves toward the third position.

5. The image forming apparatus according to claim 4, wherein the force reception portion includes a first force reception surface and a second force reception surface, and wherein when the opening/closing member is opened in a state where the supporting member is at the first position, the supporting member receives on the first force reception surface a pressing force from the restriction member, thereby moving toward the third position, and when the opening/closing member is opened in a state where the supporting member is at the second position, the supporting member receives on the second force reception surface a pressing force from the restriction member, thereby moving toward the third position.

6. The image forming apparatus according to claim 1, further comprising a linking member configured to link the restriction member and the opening/closing member, wherein the opening/closing member can move between an opened position where the opening is opened, and a closed position where the opening is closed, and while the opening/closing member moves from the opened position toward the closed position, the restriction member moves by receiving a force from the linking member.

7. The image forming apparatus according to claim 1, wherein the restriction member rotates to move between a restriction position where the restriction member restricts a movement of the supporting member, and a non-restriction position where the restriction member does not restrict the movement of the supporting member.

8. The image forming apparatus according to claim 1, wherein the supporting member includes a guide portion for guiding a movement of the developing unit.

9. The image forming apparatus according to claim 1, wherein the third position includes a first predetermined position and a second predetermined position, the first predetermined position being closer to the first position than to the second position, the second predetermined position being closer to the second position than to the first position, and wherein in a case where the opening/closing member is opened when the supporting member is at the first position, the supporting member moves to the first predetermined position, and in a case where the opening/closing member is opened when the supporting member is at the second position, the supporting member moves to the second predetermined position.

10. The image forming apparatus according to claim 1, wherein the third position is a position between the first and second positions.

11. The image forming apparatus according to claim 1, wherein the restriction member is provided to one end side of the developing unit in a longitudinal direction.

12. The image forming apparatus according to claim 11, wherein the one end side is a driving side transmitted with a driving force from the apparatus main body to the developing unit.

13. An image forming apparatus comprising:

an apparatus main body to which a developing unit including a developing roller can be attached;

an opening/closing member configured to open and close an opening through which the developing unit passes when the developing unit is detached from the apparatus main body; and a restriction member configured to restrict a movement of the developing unit attached to the apparatus main body, wherein the developing unit attached to the apparatus main body can move between a development position where the developing roller can attach toner to a photosensitive member, and a separate position where the developing roller is separate from the photosensitive member so that the developing roller does not attach toner to the photosensitive member, and wherein the opening/closing member is opened, whereby the developing unit moves to a detachment position where the developing unit can be detached from the apparatus main body and which is between the development position and the separate position, and the restriction member restricts a movement of the developing unit from the detachment position in a direction different from a detachment direction in which the developing unit is detached from the apparatus main body.

14. The image forming apparatus according to claim 13, wherein the developing unit can be detached from the apparatus main body by moving the developing unit in a direction intersecting a longitudinal direction of the developing unit.

15. The image forming apparatus according to claim 13, wherein the restriction member rotates to move between a restriction position where the restriction member restricts a movement of the developing unit, and a non-restriction position where the restriction member does not restrict the movement of the developing unit.

16. The image forming apparatus according to claim 13, wherein the restriction member includes a guide portion for guiding a movement of the developing unit in the detachment direction.

17. An image forming apparatus comprising:

an apparatus main body to which a developing unit including a developing roller can be attached;

an opening/closing member configured to open and close an opening through which the developing unit passes when the developing unit is detached from the apparatus main body; and a moving member configured to move the developing unit attached to the apparatus main body, wherein when the moving member presses the developing unit at a first pressing position, the developing unit is at a development position where the developing roller can attach toner to a photosensitive member, and when the moving member presses the developing unit at a second pressing position, the developing unit is at a separate position where the developing roller is further away from the photosensitive member than at the development position, and wherein in a case where the opening/closing member is opened when the moving member presses the developing unit at the first pressing position, the moving member releases the pressing of the developing unit, and in a case where the opening/closing member is opened when the moving member presses the developing unit at the second pressing position, the moving member releases the pressing of the developing unit.

18. The image forming apparatus according to claim 17, wherein in a case where the opening/closing member is opened when the moving member is at the first pressing position, the moving member moves to a pressing release position where the pressing of the developing unit by the moving member is released, and in a case where the opening/closing member is opened when the moving member is at the second pressing position, the moving member moves to the pressing release position.

19. The image forming apparatus according to claim 18, wherein when the moving member is at the pressing release position, the moving member is not in contact with the developing unit.

20. The image forming apparatus according to claim 18, further comprising a release member configured to press the moving member to move to the pressing release position in relation to an operation of opening the opening/closing member.

21. The image forming apparatus according to claim 17, wherein the moving member includes a recessed portion, the developing unit includes a pressing target portion to be pressed by the moving member, and when the pressing target portion is inserted into the recessed portion, the moving member can press the developing unit.

22. The image forming apparatus according to claim 21, wherein the pressing target portion is inserted into the recessed portion by moving the moving member to the first pressing position in a state where the developing unit is attached to the apparatus main body, and the moving member is at the second pressing position, and the pressing target portion is not inserted into the recessed portion.

* * * * *